US009099042B2

(12) United States Patent
Sugiyama et al.

(10) Patent No.: US 9,099,042 B2
(45) Date of Patent: Aug. 4, 2015

(54) DISPLAY APPARATUS

(75) Inventors: Koichi Sugiyama, Osaka (JP); Taikoh Akashi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 333 days.

(21) Appl. No.: 13/697,775

(22) PCT Filed: Apr. 13, 2011

(86) PCT No.: PCT/JP2011/059216

§ 371 (c)(1),
(2), (4) Date: Nov. 13, 2012

(87) PCT Pub. No.: WO2011/142202

PCT Pub. Date: Nov. 17, 2011

(65) Prior Publication Data

US 2013/0063471 A1 Mar. 14, 2013

(30) Foreign Application Priority Data

May 12, 2010 (JP) ..... 2010-110675
May 12, 2010 (JP) ..... 2010-110676

(51) Int. Cl.
*G09G 5/02* (2006.01)
*G09G 3/34* (2006.01)
*G09G 3/36* (2006.01)

(52) U.S. Cl.
CPC ..... *G09G 3/3406* (2013.01); *G09G 3/3611* (2013.01); *G09G 2300/0456* (2013.01);
(Continued)

(58) Field of Classification Search
CPC . G09G 3/2003; G09G 3/3406; G09G 3/3607; G09G 2300/0456; G09G 2320/0233; G09G 2320/0276; G09G 2320/0626; G09G 2320/0646; G09G 2340/06; G09G 2340/0457; G09G 2360/145
USPC ..... 345/77, 102, 207, 589, 690, 694
See application file for complete search history.

(56) References Cited

U.S. PATENT DOCUMENTS 6,567,543 B1 * 5/2003 Shiraiwa et al. ..... 382/167
8,390,644 B2 * 3/2013 Marcu et al. ..... 345/590
(Continued)

FOREIGN PATENT DOCUMENTS

JP 6-18880 A 1/1994
JP 7-255063 A 10/1995
(Continued)

OTHER PUBLICATIONS

International Preliminary Report on Patentability and Written Opinion of the International Searching Authority, dated Nov. 22, 2012, for International Application No. PCT/JP2011/059216 and English translation thereof dated Dec. 20, 2012.
(Continued)

*Primary Examiner* — Joe H Cheng
(74) *Attorney, Agent, or Firm* — Birch, Stewart, Kolasch & Birch, LLP

(57) ABSTRACT

A high luminance display apparatus is provided. When a spectral radiance of a backlight at a time point of factory shipment is less than a spectral radiance of external light, a CPU generates a correction matrix for performing color correction so that color produced by external light, i.e., color produced by reflection light of external light by a half mirror conforms to color produced by only irradiation light of the backlight, transmits the generated correction matrix to a video image signal processing section as parameter information, and causes execution of color correction based on the parameter information. The CPU generates a correction matrix based on a spectral radiance of external light detected by a second spectral radiance sensor, a spectral radiance of the backlight detected at the time point of factory shipment, and spectral transmittance of a color filter as well as a color-matching function.

24 Claims, 16 Drawing Sheets

(52) U.S. Cl.
CPC ..... *G09G2320/0626* (2013.01); *G09G 2320/0666* (2013.01); *G09G 2360/144* (2013.01); *G09G 2360/145* (2013.01)

(56) References Cited

U.S. PATENT DOCUMENTS

| | | | | |
|---|---|---|---|---|
| 8,847,972 | B2 * | 9/2014 | Kane et al. | 345/589 |
| 2003/0011563 | A1 | 1/2003 | Wada | |
| 2004/0095402 | A1 | 5/2004 | Nakano | |
| 2005/0231457 | A1 | 10/2005 | Yamamoto et al. | |
| 2006/0066778 | A1 * | 3/2006 | Miyazaki | 349/106 |
| 2007/0103491 | A1 | 5/2007 | Moriya et al. | |
| 2007/0188439 | A1 | 8/2007 | Kimura et al. | |
| 2007/0188441 | A1 | 8/2007 | Tanaka et al. | |
| 2008/0238931 | A1 * | 10/2008 | Komiya et al. | 345/589 |
| 2009/0219253 | A1 * | 9/2009 | Izadi et al. | 345/173 |
| 2009/0231313 | A1 | 9/2009 | Teranishi et al. | |
| 2009/0322863 | A1 * | 12/2009 | Takahashi | 348/65 |
| 2010/0201716 | A1 * | 8/2010 | Tanizoe et al. | 345/690 |
| 2010/0289962 | A1 * | 11/2010 | Kim et al. | 348/649 |
| 2011/0063341 | A1 * | 3/2011 | Knicely et al. | 345/690 |
| 2012/0032969 | A1 * | 2/2012 | Sugiyama | 345/589 |

FOREIGN PATENT DOCUMENTS

| | | | |
|---|---|---|---|
| JP | 9-311317 | A | 12/1997 |
| JP | 2001-320725 | A | 11/2001 |
| JP | 2003-209855 | A | 7/2003 |
| JP | 2004-170721 | A | 6/2004 |
| JP | 2004-294765 | A | 10/2004 |
| JP | 2005-258404 | A | 9/2005 |
| JP | 2005-316332 | A | 11/2005 |
| JP | 2007-127781 | A | 5/2007 |
| JP | 2007-132958 | A | 5/2007 |
| JP | 2007-133347 | A | 5/2007 |
| JP | 2007-140260 | A | 6/2007 |
| JP | 2007-212890 | A | 8/2007 |
| JP | 2007-219125 | A | 8/2007 |
| JP | 2007-334313 | A | 12/2007 |
| JP | 2008-242111 | A | 10/2008 |
| JP | 2009-109638 | A | 5/2009 |
| JP | 2010-48920 | A | 3/2010 |
| JP | 2010-181806 | A | 8/2010 |

OTHER PUBLICATIONS

International Search Report, dated May 17, 2011, issued in PCT/JP2011/059216.

* cited by examiner

DISPLAY APPARATUS

TECHNICAL FIELD

The present invention relates to a display apparatus capable of performing color correction according to external light.

BACKGROUND ART

A display apparatus has a problem of impaired visibility due to higher luminance of external light than luminance of the display apparatus at the time of being used for digital signage, or electronic signage that is placed outdoors, for example. Further, the luminance of the display apparatus is increased for prevention of an effect of external light, which results in increase of consumption power and costs, thus posing a problem. In order to solve these problems, a semi-transmissive liquid crystal display apparatus has been proposed.

The semi-transmissive liquid crystal display apparatus is a liquid crystal display apparatus which is a hybrid type of a transmissive liquid crystal display apparatus of a backlight-type or the like and a reflective liquid crystal display apparatus. The semi-transmissive liquid crystal display apparatus switches between modes so that in the daytime, reflection of external light such as sunlight is used to produce color, and in cloudy weather or at night, color is produced with use of transmission of backlight.

Video image contents such as static images and moving images are usually created by being targeted at a transmissive liquid crystal display apparatus. Therefore, a semi-transmissive liquid crystal display apparatus having a half mirror or a reflective liquid crystal display apparatus is affected by external light so that color gamut or white balance fluctuate, resulting in display of a video image content in color different from what is intended by a content creator, in some cases.

FIG. 18 is a view showing xy chromaticity 61 at the time of occurrence of color shift due to an effect of external light. The xy chromaticity 61 is xy chromaticity in XYZ colorimetric system which is specified by CIE (Commission Internationale de l'Eclairage), and y chromaticity of the xy chromaticity is on the ordinate and x chromaticity of the xy chromaticity is on the abscissa. Color gamut 605 is color gamut of a color-matching function according to CIE1931. Color gamut 611 is color gamut in producing color with external light, and color gamut 602 is color gamut in producing color with a backlight. The color gamut 611 is shifted with respect to the color gamut 602, and shows that there occurs color shift. Furthermore, white point 613 with external light is shifted from white point 604 with a backlight. That is, color produced at the time of the backlight transmission is different from color produced at the time of the external light reflection.

It has been known that the semi-transmissive liquid crystal display apparatus using a half mirror has an external light reflectivity of several percent with respect to external light luminance of several tens of thousands (cd/m$^2$), for example. This is ascribed to that in a process of reflecting external light with a half mirror, the light needs to pass through a protective glass in the front, a polarizing plate, a liquid crystal display (hereinafter, referred to as "LCD") panel, a color filter and the like, so that light attenuates due to absorption and diffusion. That is, in the semi-transmissive liquid crystal display apparatus using a half mirror, the reflective rate of external light is low, which results in low luminance generation efficiency.

Additionally, in a display apparatus that is placed outdoors, when a screen size is increased such that the screen size exceeds 100 inches, a part of an area on a screen is illuminated with external light so as to be brighter than the other areas, in some cases. That is, different external light conditions for screen areas may cause luminance and chromaticity for the respective areas to be different.

As a first conventional art, there is an environment-responsive image display system described in Patent Literature 1. The environment-responsive image display system corrects a profile for input and output of a projector based on colored light information of an image display area measured by a colored light sensor. Specifically, coordinate values serving as a complementary pair are operated with a coordinate value in color space under a reference environment which is obtained based on the colored light information in the previous processing and a coordinate value under an actual visual environment, and the profile for input and output is corrected with the coordinate values serving as a complementary pair. The coordinate values serving as a complementary pair are obtained by calculating an inverse vector of a fixed vector showing a coordinate position of a white color value under an actual presentation environment in color space.

As a second conventional art, there is an image observation apparatus described in Patent Literature 2. The image observation apparatus is capable of switching between a reflective type and a transmissive type. When the reflective type is selected, color correction of a display image is performed based on external light information such as a color temperature of external light obtained by an external sensor and information added to image data to be displayed.

As a third conventional art, there is a mobile data processing apparatus described in Patent Literature 3. The mobile data processing apparatus is one using a semi-transmissive liquid crystal display device and controls luminance of a liquid crystal illumination part for causing data to be displayed on a liquid crystal display part with light caused by irradiation from backward of the semi-transmissive liquid crystal display device according to a measured result of a sensor for measuring external luminous energy incident upon the semi-transmissive liquid crystal display device.

As a fourth conventional art, there is a liquid crystal display control apparatus described in Patent Literature 4. The liquid crystal display control apparatus adjusts backlight luminance based on illuminance data from a illumination detection part for detecting luminous energy of external light irradiating a liquid crystal display part from outside, and adjusts a contrast based on the illuminance data from a illumination detection part and temperature data from a temperature detection part for detecting a temperature of the liquid crystal display part.

As a fifth conventional art, there is a display apparatus described in Patent Literature 5. The display apparatus is a semi-transmissive liquid crystal display apparatus for controlling emission intensity of illuminating means of a display panel according to output of an optical sensor disposed at the periphery of a display area, and has spectral sensitivity adjustment means for matching spectral sensitivity of the optical sensor with a visibility characteristic of human.

CITATION LIST

Patent Literatures

Patent Literature 1: Japanese Unexamined Patent Publication JP-A 2001-320725

Patent Literature 2: Japanese Unexamined Patent Publication JP-A 2003-209855

Patent Literature 3: Japanese Unexamined Patent Publication JP-A 6-18880 (1994)

Patent Literature 4: Japanese Unexamined Patent Publication JP-A 9-311317 (1997)

Patent Literature 5: Japanese Unexamined Patent Publication JP-A 2007-212890

SUMMARY OF INVENTION

Technical Problem

However, the first conventional art is used for a projector, and not used for the semi-transmissive or transmissive liquid crystal display apparatus. Moreover, any of the second to fourth conventional art does not use a spectral characteristic of external light. The fifth conventional art is one for adjusting spectral sensitivity of an optical sensor, and does not improve visibility using a spectral characteristic of external light. Additionally, none of the conventional art solves the above-described problems. Further, none of the conventional art is solution for correcting color shift which is different for respective areas.

An object of the invention is to provide a high luminance display apparatus capable of correcting color shift due to an effect of external light and the like.

Solution to Problem

The invention provides a display apparatus comprising:

a display section having a color filter and a display screen for displaying image information;

a backlight section disposed on a back side of the display section that is an opposite side of the display screen;

a half mirror disposed between the display section and the backlight section or an external light acquisition section disposed at a peripheral section of the display section, irradiation light caused by irradiation of the backlight section, and reflection light of external light by the half mirror or external light acquired by the external light acquisition section; or the reflection light or the acquired external light being allowed to pass through the color filter to produce color of image information, the display apparatus further comprising:

a spectral characteristic detection section that detects a spectral characteristic which is represented as luminous energy of the irradiation light and luminous energy of the external light irradiating the display section from outside at a predetermined wavelength interval within a predetermined wavelength range;

a color correction section that performs color correction of image information to be displayed on the display section, and supplies the image information subjected to the color correction to the display section for display; and a control section that causes the spectral characteristic detection section to detect the spectral characteristic of the luminous energy of the irradiation light and the spectral characteristic of the luminous energy of the external light, generates color correction information based on the spectral characteristic of the irradiation light and the spectral characteristic of the external light detected by the spectral characteristic detection section, and supplies the generated color correction information to the color correction section to cause the color correction section to perform color correction of image information to be displayed based on the supplied color correction information.

Further, the invention provides a display apparatus comprising:

a display section having a color filter and a display screen divided into a plurality of areas for displaying image information;

a backlight section disposed on a back side of the display section that is an opposite side of the display screen; and a half mirror disposed between the display section and the backlight section or a plurality of external light acquisition sections disposed at a peripheral section of the display section, irradiation light caused by irradiation of the backlight section, and reflection light of external light by the half mirror or acquired external light acquired by the plurality of external light acquisition sections; or the reflection light or the acquired external light being allowed to pass through the color filter disposed at the display section to produce color of image information, the display apparatus further comprising:

a first spectral characteristic detection section that detects a spectral characteristic which is represented as luminous energy of the irradiation light at a predetermined wavelength interval within a predetermined wavelength range;

a plurality of second spectral characteristic detection sections that are disposed at the peripheral section of the display screen of the display section by being associated with each of the plurality of areas, and detect a spectral characteristic which is represented as luminous energy of external light irradiating the display section from outside at a predetermined wavelength interval within a predetermined wavelength range;

a color correction section that performs color correction of image information to be displayed on the display section, and supplies the image information subjected to the color correction to the display section for display; and a control section that causes the first spectral characteristic detection section to detect the spectral characteristic of the luminous energy of the irradiation light, causes the second spectral characteristic detection section to detect the spectral characteristic of the luminous energy of the external light, generates color correction information for each of the areas based on the spectral characteristic of the irradiation light detected by the first spectral characteristic detection section and the spectral characteristic of the external light detected by the plurality of second spectral characteristic detection sections, and supplies the generated color correction information to the color correction section for causing the color correction section to perform color correction of image information to be displayed for each of the areas based on the supplied color correction information.

Further, in the invention, it is preferable that the control section calculates a correction matrix for color correction based on the spectral characteristic of the irradiation light and the spectral characteristic of the external light detected by the spectral characteristic detection section, spectral transmittance of the color filter disposed at the display section as well as a color matching function, to define the calculated correction matrix as color correction information, or the control section calculates, for each of the areas, a correction matrix for color correction based on the spectral characteristic of the irradiation light detected by the first spectral characteristic detection section and the spectral characteristic of the external light detected by the second spectral characteristic detection section, spectral transmittance of the color filter disposed at the display section as well as a color matching function, to define the calculated correction matrix as color correction information.

Further, in the invention, it is preferable that the control section causes the spectral characteristic detection section to detect a spectral characteristic of external light irradiating the display section from outside for each first time interval, and generates the color correction information when a difference of the spectral characteristic of the external light between a start time point of the first time and a time point after the first time is greater than or equal to a first threshold.

Further, in the invention, it is preferable that the control section, for each of the areas, causes the second spectral characteristic detection section to detect a spectral characteristic of external light irradiating the display section from outside for each first time interval, and generates the color correction information when a difference of the spectral characteristic of the external light between a start time point of the first time and a time point after the first time is greater than or equal to a first threshold.

Further, in the invention, it is preferable that the control section causes the spectral characteristic detection section or the first spectral characteristic detection section to detect a spectral characteristic of irradiation light from the backlight section at a predetermined time point and for each second time interval after the predetermined time point, and generates, when a difference between the spectral characteristic at the predetermined time point and the spectral characteristic at the second time interval is greater than or equal to a second threshold, based on the spectral characteristic at the predetermined time point and the spectral characteristic at the second time interval, color correction information for bringing color of image information produced with the irradiation light of the spectral characteristic which is the second threshold to conform to color of image information produced with the irradiation light at the predetermined time point, and supplies the generated color correction information to the color correction section.

Further, in the invention, it is preferable that the control section causes the backlight section to perform irradiation with irradiation light, when luminous energy shown by the spectral characteristic of the external light detected by at least any one second spectral characteristic detection section among the plurality of second spectral characteristic detection sections is less than luminous energy shown by the spectral characteristic of the irradiation light detected by the first spectral characteristic detection section, and generates, for each of the areas, based on the spectral characteristic of the irradiation light detected by the first spectral characteristic detection section and the spectral characteristic of the external light detected by the plurality of second spectral characteristic detection sections, color correction information for bringing color of image information produced when the irradiation light and the reflection light or the acquired external light are allowed to pass through the color filter to conform to color of image information produced by allowing only the irradiation light from the backlight section to pass through the color filter.

Further, in the invention, it is preferable that the control section causes the backlight section to perform irradiation with irradiation light, when the spectral characteristic of the external light detected by at least any one second spectral characteristic detection section among the plurality of second spectral characteristic detection sections is less than the spectral characteristic of the irradiation light detected by the first spectral characteristic detection section, and generates, for each of the areas, based on the spectral characteristic of the irradiation light detected by the first spectral characteristic detection section and the spectral characteristic of the external light detected by the plurality of second spectral characteristic detection sections, color correction information for bringing color of image information produced when the irradiation light and the reflection light or the acquired external light are allowed to pass through the color filter to conform to color of image information produced by allowing only the irradiation light from the backlight section to pass through the color filter.

Further, in the invention, it is preferable that the control section calculates a difference between respective luminous energy shown by two spectral characteristics at the predetermined wavelength interval on the predetermined wavelength range to define an average of a total of the calculated difference as a difference of the two spectral characteristics.

Further, in the invention, it is preferable that the spectral characteristic is a luminance characteristic represented for each wavelength in a visible light area.

Further, in the invention, it is preferable that the display apparatus further includes a diffuser plate for diffusing the irradiation light and the acquired external light, and the spectral characteristic detection section, or the first spectral characteristic detection section and the plurality of second spectral characteristic detection sections detect a spectral characteristic of light diffused by the diffuser plate.

Further, in the invention, it is preferable that the display apparatus further includes an optical fiber for guiding a part of irradiation light caused by irradiation of the backlight section to the spectral characteristic detection section, or the first spectral characteristic detection section.

Further, in the invention, it is preferable that the optical fiber guides acquired external light acquired by the external light acquisition section or the plurality of external light acquisition sections to the spectral characteristic detection section, or the second spectral characteristic detection section.

Further, in the invention, it is preferable that the display apparatus is a semi-transmissive liquid crystal display apparatus including the display section, the backlight section and the half mirror.

Further, in the invention, it is preferable that the display apparatus is a transmissive liquid crystal display apparatus including the display section, the backlight section including a light guide plate that guides external light, and the external light acquisition section which is an opening for acquiring external light.

Further, in the invention, it is preferable that the display apparatus is a transmissive liquid crystal display apparatus including the display section, the backlight section including a light guide plate that guides external light, and the external light acquisition section which is an opening disposed at a peripheral section of the backlight section for acquiring external light, and the plurality of second spectral characteristic detection sections, each of which is arranged in a vicinity of each of the external light acquisition sections.

Advantageous Effects of Invention

According to the invention, a display apparatus includes a display section having a color filter and a display screen for displaying image information, a backlight section disposed on a back side of the display section that is an opposite side of the display screen, a half mirror disposed between the display section and the backlight section or an external light acquisition section disposed at a peripheral section of the display section, in which irradiation light caused by irradiation of the backlight section, and reflection light of external light by the half mirror or acquired external light acquired by the external light acquisition section; or the reflection light or the acquired external light is allowed to pass through the color filter to produce color of image information. In the display apparatus, a spectral characteristic detection section detects a spectral characteristic which is represented as luminous energy of the irradiation light and luminous energy of the external light irradiating the display section from outside at a predetermined wavelength interval within a predetermined wavelength range. A color correction section performs color correction of image information to be displayed on the display section, and supplies the image information subjected to the color correction to the display section for display. A control section, then, causes the spectral characteristic detection section to detect the spectral characteristic of the luminous energy of the irradiation light and the spectral characteristic of the luminous energy of the external light, generates color correction information based on the spectral characteristic of the irradiation light and the spectral characteristic of the external light detected by the spectral characteristic detection section, and supplies the generated color correction information to the color correction section to cause the color correction section to perform color correction of image information to be displayed based on the supplied color correction information.

Therefore, it is possible to correct color shift due to an effect of external light and the like. Especially, in digital signage using the display apparatus, for example, the semi-transmissive liquid crystal display apparatus or the transmissive liquid crystal display apparatus capable of achieving high luminance with acquired external light, spectral characteristics of external light and irradiation light from the backlight section are detected by the spectral characteristic detection section such as a spectral luminance sensor, and color correction is performed based on the detected spectral characteristics so that deterioration in visibility due to an effect of external light or temporal change of the backlight section is prevented, and it is possible to mend the problem of color shift and shortage of luminance in the backlight irradiation mode, the external light mode, and the backlight irradiation and external light mode in the semi-transmissive liquid crystal display apparatus or the transmissive liquid crystal display apparatus.

According to the invention, the display apparatus includes a display section having a color filter and a display screen divided into a plurality of areas for displaying image information, a backlight section disposed on a back side of the display section that is an opposite side of the display screen, a half mirror disposed between the display section and the backlight section or a plurality of external light acquisition sections disposed at a peripheral section of the display section, in which irradiation light caused by irradiation of the backlight section, and reflection light of external light by the half mirror or acquired external light acquired by the plurality of external light acquisition sections; or the reflection light or the acquired external light is allowed to pass through the color filter to produce color of image information. In the display apparatus, a first spectral characteristic detection section detects a spectral characteristic which is represented as luminous energy of the irradiation light at a predetermined wavelength interval within a predetermined wavelength range. A plurality of second spectral characteristic detection sections are disposed at the peripheral section of the display screen of the display section by being associated with each of the plurality of areas, and detect a spectral characteristic which is represented as luminous energy of external light irradiating the display section from outside at a predetermined wavelength interval within a predetermined wavelength range. A color correction section performs color correction of image information to be displayed on the display section, and supplies the image information subjected to the color correction to the display section for display. A control section, then, causes the first spectral characteristic detection section to detect the spectral characteristic of the luminous energy of the irradiation light, causes the second spectral characteristic detection section to detect the spectral characteristic of the luminous energy of the external light, generates color correction information for each of the areas based on the spectral characteristic of the irradiation light detected by the first spectral characteristic detection section and the spectral characteristic of the external light detected by the plurality of second spectral characteristic detection sections, and supplies the generated color correction information to the color correction section for causing the color correction section to perform color correction of image information to be displayed for each of the areas based on the supplied color correction information.

Therefore, it is possible to correct color shift for each of the areas of the screen due to an effect of external light and the like. Especially, in digital signage using the display apparatus, for example, the semi-transmissive liquid crystal display apparatus or the transmissive liquid crystal display apparatus capable of achieving high luminance with acquired external light, the spectral characteristic of the irradiation light is detected by the first spectral characteristic detection section such as a first spectral radiance sensor, the spectral characteristic of the external light is detected by the plurality of second spectral characteristic detection sections such as second spectral radiance sensors, and color correction is performed for each of the areas based on the detected spectral characteristics so that deterioration in visibility due to an effect of external light or temporal change of the backlight section is prevented, and it is possible to mend the problem of color shift and shortage of luminance in the backlight irradiation mode, the external light mode, and the backlight irradiation and external light mode in the semi-transmissive liquid crystal display apparatus or the transmissive liquid crystal display apparatus.

Moreover, in either one of a case of placing outdoors subjected to an effect of external light and a case of placing indoors depending on backlight irradiation, there occurs no color shift even when the same image is displayed, so that an observer will not be given a sense of discomfort in color reproducibility, which thereby enables to achieve a display apparatus capable of being used both for placing outdoors and for placing indoors.

According to the invention, the control section calculates a correction matrix for color correction based on the spectral characteristic of the irradiation light and the spectral characteristic of the external light detected by the spectral characteristic detection section, spectral transmittance of the color filter disposed at the display section as well as a color matching function, to define the calculated correction matrix as color correction information. Alternatively, the control section calculates, for each of the areas, a correction matrix for color correction based on the spectral characteristic of the irradiation light detected by the first spectral characteristic detection section and the spectral characteristic of the external light detected by the second spectral characteristic detection section, spectral transmittance of the color filter disposed at the display section as well as a color matching function, to define the calculated correction matrix as color correction information. Accordingly, the correction matrix which is the color correction information capable of performing correction of color shift more accurately is able to be calculated preferably for each of the areas.

According to the invention, the control section, preferably for each of the areas, causes the spectral characteristic detection section or the second spectral characteristic detection section to detect a spectral characteristic of external light irradiating the display section from outside for each first time interval. Then, when a difference of the spectral characteristic of the external light between a start time point of the first time and a time point after the first time is greater than or equal to a first threshold, the control section generates the color correction information. Therefore, when the degree of color shift of display color is small which is caused by deterioration in performance along with temporal change of the external light, operation processing for performing the color correction is able to be omitted, which thereby not causing delay in screen display.

According to the invention, the control section causes the spectral characteristic detection section or the first spectral characteristic detection section to detect a spectral characteristic of irradiation light from the backlight section at a predetermined time point and for each second time interval after the predetermined time point. Then, when a difference between the spectral characteristic at the predetermined time point and the spectral characteristic at the second time interval is greater than or equal to a second threshold, based on the spectral characteristic at the predetermined time point and the spectral characteristic at the second time interval, the control section generates color correction information for bringing color of image information produced with the irradiation light of the spectral characteristic which is the second threshold to conform to color of image information produced with the irradiation light at the predetermined time point, and supplies the generated color correction information to the color correction section.

Therefore, even when there occurs change due to temporal change in irradiation light by the backlight section used in the display apparatus, color correction for the temporal change is performed so that color shift due to deterioration in performance of the backlight section is suppressed, and it is possible to maintain display of color produced in a condition which is equivalent to that at the time of factory shipment of the display apparatus.

According to the invention, the control section causes the backlight section to perform irradiation with irradiation light, when luminous energy shown by the spectral characteristic of the external light detected by the spectral characteristic detection section is less than luminous energy shown by the spectral characteristic of the irradiation light detected by the spectral characteristic detection section. Then, based on the spectral characteristic of the irradiation light and the spectral characteristic of the external light detected by the spectral characteristic detection section, the control section generates color correction information for bringing color of image information produced when the irradiation light and the reflection light or the acquired external light are allowed to pass through the color filter to conform to color of image information produced by allowing only the irradiation light from the backlight section to pass through the color filter. Alternatively, the control section causes the backlight section to perform irradiation with irradiation light, when luminous energy shown by the spectral characteristic of the external light detected by at least any one second spectral characteristic detection section among the plurality of second spectral characteristic detection sections is less than luminous energy shown by the spectral characteristic of the irradiation light detected by the first spectral characteristic detection section. Then, based on the spectral characteristic of the irradiation light detected by the first spectral characteristic detection section and the spectral characteristic of the external light detected by the plurality of second spectral characteristic detection sections, the control section generates, for each of the areas, color correction information for bringing color of image information produced when the irradiation light and the reflection light or the acquired external light are allowed to pass through the color filter to conform to color of image information produced by allowing only the irradiation light from the backlight section to pass through the color filter.

Therefore, when there is a shortage of luminance in external light, the luminance is supplemented with luminance of the irradiation light by the backlight section, so that it is possible to produce color of image information with light combining the irradiation light by the backlight section and the external light. Color correction is performed by obtaining, preferably for each of the areas, color correction information for performing color correction, for example, a correction matrix based on the spectral characteristics of the irradiation light by the backlight section and the external light, so that it is possible to obtain display of color produced which is equivalent to that with only the irradiation light by the backlight section.

According to the invention, the control section calculates a difference between respective luminous energy shown by two spectral characteristics at the predetermined wavelength interval on the predetermined wavelength range to define an average of a total of the calculated difference as the difference of the two spectral characteristics. Therefore, even when the luminance changes depending on the wavelength, it is possible to obtain the difference between the two spectral characteristics.

According to the invention, the spectral characteristic is a luminance characteristic represented for each wavelength in a visible light area (380 to 780 (nm)), so that it is possible to perform correction for each wavelength, and to perform more accurate correction of color shift.

According to the invention, the display apparatus further includes a diffuser plate for diffusing the irradiation light and the acquired external light. Then, the spectral characteristic detection section, or the first spectral characteristic detection section and the plurality of second spectral characteristic detection sections detect a spectral characteristic of light diffused by the diffuser plate, so that even when there is unevenness in luminance regionally, it is possible to detect luminance appropriately.

According to the invention, the display apparatus further includes an optical fiber for guiding a part of irradiation light caused by irradiation of the backlight section to the spectral characteristic detection section, or the first spectral characteristic detection section, so that even when the spectral characteristic detecting section or the first spectral characteristic detecting section is provided as being separated from the backlight section, it is possible to suppress attenuation of light.

According to the invention, the optical fiber guides acquired external light acquired by the external light acquisition section or the plurality of external light acquisition sections to the spectral characteristic detection section, or the second spectral characteristic detection section, so that it is possible to suppress attenuation of light also for acquired external light.

According to the invention, the display apparatus is a semi-transmissive liquid crystal display apparatus including the display section, the backlight section and the half mirror. Accordingly, it is possible to realize the apparatus as the semi-transmissive liquid crystal display apparatus with irradiation light by the backlight section and reflection external light as well as preventing deterioration in visibility due to external light, thereby allowing suppression of color shift and luminance change due to external light.

According to the invention, the display apparatus is a transmissive liquid crystal display apparatus including the display section, the backlight section including a light guide plate that guides external light, and the external light acquisition section which is an opening for acquiring external light. Alternatively, the display apparatus is a transmissive liquid crystal display apparatus including the display section, the backlight section including a light guide plate that guides external light, and the external light acquisition section which is an opening disposed at a peripheral section of the backlight section for acquiring external light. Then, each of the plurality of second spectral characteristic detection sections is arranged in a vicinity of each of the external light acquisition sections. Accordingly, it is possible to realize the apparatus as the transmissive liquid crystal display apparatus with irradiation light by the backlight section and acquired external light by the opening, or the plurality of openings and the light guide plate as well as preventing deterioration in visibility due to external light, and allowing suppression of color shift and luminance change due to external light.

DESCRIPTION OF EMBODIMENTS

Other and further objects, features, and advantages of the invention will be more explicit from the following detailed description taken with reference to the drawings.

Description will hereinafter be given in detail for preferred embodiments of the invention with reference to the drawings.

Figure 1A:
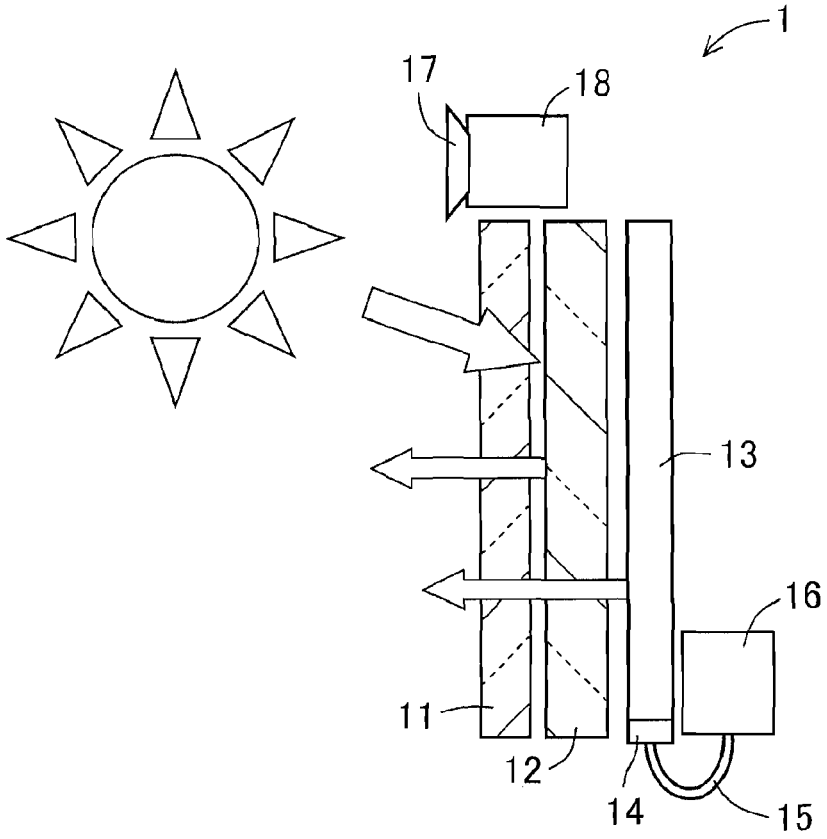
FIG. 1A is a side view schematically showing external appearance of a semi-transmissive liquid crystal display apparatus according to a first embodiment of the invention.
Figure 1B:
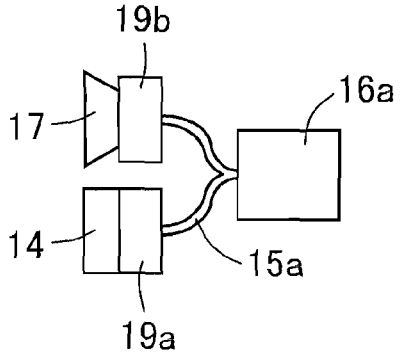
FIG. 1B is a side view schematically showing external appearance of the semi-transmissive liquid crystal display apparatus according to the first embodiment of the invention.

FIGS. 1A and 1B are side views schematically showing external appearance of a semi-transmissive liquid crystal display apparatus 1 according to a first embodiment of the invention. FIG. 1A is an external view of the semi-transmissive liquid crystal display apparatus 1 seen from a lateral side. The semi-transmissive liquid crystal display apparatus 1, which is a display apparatus, comprises a liquid crystal display (abbreviated as LCD) module 11, a half mirror 12, a backlight 13, diffuser plates 14 and 17, an optical fiber 15, a first spectral radiance sensor 16, and a second spectral radiance sensor 18.

The LCD module 11 as a display section is composed of, for example, a liquid crystal panel and displays image information. The LCD module 11 has a color filter and a display screen, which are not shown, and light is passed through the color filter from a back thereof so as to produce color of image information to be displayed. The half mirror 12 is arranged at a back of the LCD module 11, namely, a back side of the LCD module 11 that is an opposite side of the display screen. The half mirror 12 reflects external light such as sunlight which passes through the LCD module 11 or illuminated light from illumination, so that the reflection light passes through from the back of the LCD module 11 to the display screen, namely, in a front direction.

The backlight 13, which is a backlight part, is arranged at a back of the half mirror 12. That is, the LCD module 11, the half mirror 12 and the backlight 13 are arranged in this order from the front side of the LCD module 11. The backlight 13 has a light source (not shown), and performs irradiation in a direction of the half mirror 12 with irradiation light emitted from the light source so that the irradiation light passes through in the front direction of the LCD module 11 from the back of the half mirror 12.

The diffuser plate 14 is disposed below the backlight 13 in a surface direction of the screen of the LCD module 11, and diffuses and transmits the irradiation light emitted from the light source of the backlight 13 so as to be supplied to the optical fiber 15. The optical fiber 15 guides the irradiation light supplied from the diffuser plate 14 to the first spectral radiance sensor 16 so as to be supplied to the first spectral radiance sensor 16.

The first spectral radiance sensor 16 is a detection device for detecting a spectral characteristic of the irradiation light supplied from the optical fiber 15, that is, the irradiation light of the backlight 13. The spectral characteristic that is spectrum is a characteristic which is represented as luminous energy of light, namely, luminance at a predetermined wavelength interval within a predetermined wavelength range. A predetermined wavelength range is, for example, a wavelength range of 380 nm to 780 nm, and the predetermined wavelength interval is, for example, a wavelength interval of 1 nm.

The diffuser plate 17 diffuses and transmits external light irradiating the diffuser plate 17 from the front side of the LCD module 11, thereby supplying to the second spectral radiance sensor 18. The second spectral radiance sensor 18 is a detection device which is arranged next to the back of the diffuser plate 17, and detects a spectral characteristic of external light supplied from the diffuser plate 17. The diffuser plate 17 and the second spectral radiance sensor 18 are arranged above the LCD module 11 in a surface direction of the screen of the LCD module 11. The diffuser plate 14 and 17 are arranged for the purpose of prevention of damage due to direct light incidence and prevention of deterioration in measurement accuracy due to various image formation, for the first spectral radiance sensor 16 and the second spectral radiance sensor 18, which therefore are not necessarily limited to the present configuration.

FIG. 1B is a view schematically showing an example of optical fiber 15*a* and a spectral radiance sensor 16*a* different from the configuration shown in FIG. 1A. In a configuration shown in FIG. 1B, in place of the optical fiber 15, the first spectral radiance sensor 16 and the second spectral radiance sensor 18 shown in FIG. 1A, optical fiber 15*a*, a spectral radiance sensor 16*a* and electronic shutters 19*a* and 19*b* are used.

The optical fiber 15*a* guides and supplies irradiation light acquired through the diffuser plate 14 to the spectral radiance sensor 16*a* as well as guiding and supplying external light acquired through the diffuser plate 17 to the spectral radiance sensor 16*a*. The optical fiber 15*a* is connected to the diffuser plate 14 through the electronic shutter 19*a* as well as connected to the diffuser plate 17 through the electronic shutter 19*b*. The electronic shutters 19*a* and 19*b* are not opened simultaneously, and both of them are closed, or only one of them is opened.

The spectral radiance sensor 16*a* is a detection device for detecting a spectral characteristic of incident light supplied from the optical fiber 15. When the electronic shutter 19*a* is opened, the spectral radiance sensor 16*a* detects a spectral characteristic of the irradiation light acquired through the diffuser plate 14, and when the electronic shutter 19*b* is opened, detects a spectral characteristic of the external light acquired through the diffuser plate 17.

Each of the first spectral radiance sensor 16, the second spectral radiance sensor 18 and the spectral radiance sensor 16*a* is configured by, for example, a spectral radiance meter of a polychromator-type using a diffraction grating or a luminance colorimeter of a filter type. The polychromator-type spectral radiance meter focuses light to be measured with a lens, separates the focused light with a grating or a diffraction grating for each wavelength, and measures luminance for each wavelength with a plurality of photo sensors, for example, a photodiode array. The luminance colorimeter of a filter type is inferior in accuracy to the spectral radiance meter of a polychromator-type. The first spectral radiance sensor 16 and the second spectral radiance sensor 18, or the spectral radiance sensor 16*a* is a spectral characteristic detection section.

In the configuration shown in FIG. 1A, the two spectral radiance sensors of the first spectral radiance sensor 16 and the second spectral radiance sensor 18 are used, however, in the configuration shown in FIG. 1B, the one spectral radiance sensor 16*a* is only needed so that the number of the spectral radiance sensors is able to be reduced.

Figure 2:
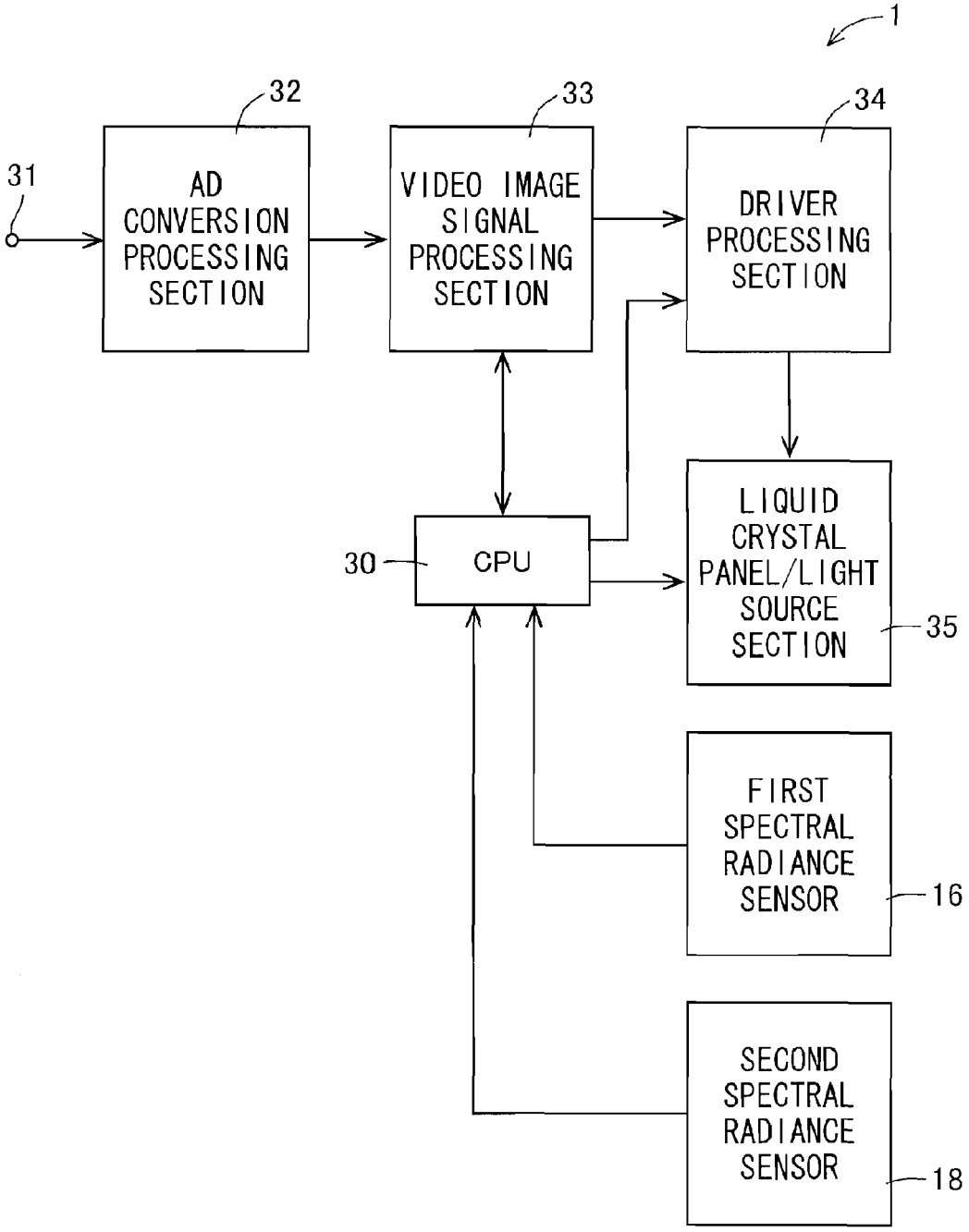
FIG. 2 is a block diagram showing a configuration of the semi-transmissive liquid crystal display apparatus.

FIG. 2 is a block diagram showing a configuration of the semi-transmissive liquid crystal display apparatus 1. The semi-transmissive liquid crystal display apparatus 1 comprises a central processing unit (abbreviated as CPU) 30, a storage device (not shown), an input terminal 31, an analog-digital (hereinafter, referred to as "AD") conversion processing section 32, a video image signal processing section 33, a driver processing section 34 and a liquid crystal panel/light source section 35, in addition to the first spectral radiance sensor 16 and the second spectral radiance sensor 18 shown in FIG. 1A.

The CPU 30, which is a control section, executes a program stored in a storage device (not shown) so as to control the video image signal processing section 33, the driver processing section 34 and the liquid crystal panel/light source section 35. The storage device (not shown) is composed of a semiconductor memory, for example, and stores a program executed by the CPU 30 and information used by the CPU 30 in executing the program.

The input terminal 31 is a terminal to which image information outputted by a receiving apparatus receiving television broadcast and the like, image information reproduced by a recording and reproducing apparatus recording and reproducing image information, image information reproduced by a computer, or the like is inputted as an analog signal. For the image information with the analog signal inputted to the input terminal, the AD conversion processing section 32 converts the analog signal to a digital signal to transmit the image information with the converted digital signal to the video image signal processing section 33. Here, the image information inputted from the input terminal 31 may be a digital signal. In this case, the AD conversion processing section 32 is not required.

The video image signal processing section 33, which is a color correction section, performs color correction of image information received from the AD conversion processing section 32 by an instruction from the CPU 30, and the image information subjected to the color correction is transmitted to the driver processing section 34. The color correction will be described below. For the image information received from the video image signal processing section 33, the driver processing section 34 converts the digital signal to the analog signal so that the image information with the converted analog signal is transmitted to the liquid crystal panel/light source section 35. Further, the driver processing section 34 performs control for the liquid crystal panel/light source section 35, such as red green blue (abbreviated as RGB) driving control in the LCD module 11, that is, a liquid crystal panel, and luminance adjustment control of the backlight 13.

The liquid crystal panel/light source section 35 comprises the LCD module 11, the half mirror 12 and the backlight 13 shown in FIG. 1A. The liquid crystal panel/light source section 35 allows only the reflection light from the half mirror 12, or the reflection light from the half mirror 12 and the irradiation light from the backlight 13 to pass through the color filter of the LCD module 11 so that color of the image information is produced. The first spectral radiance sensor 16 transmits the detected spectral characteristic to the CPU 30. The second spectral radiance sensor 18 transmits the detected spectral characteristic to the CPU 30. Hereinafter, the spectral characteristic is also referred to as spectral radiance.

The CPU 30 generates parameter information which is color correction information required for color correction to be performed by the video image signal processing section 33 based on the spectral radiance received from the first spectral radiance sensor 16, the spectral radiance received from the second spectral radiance sensor 18, as well as spectral transmittance of a color filter, a spectral reflectivity of a half mirror, which are described below, and a color-matching function, described below, of XYZ colorimetric system. The CPU 30 transmits the generated parameter information to the video image signal processing section 33. Based on the received parameter information, the video image signal processing section 33 performs color correction to the image information received from the AD conversion processing section 32. The spectral radiance received from the first spectral radiance sensor 16 is spectral radiance of irradiation light from the backlight 13, which hereinafter will be simply referred to as spectral radiance of a backlight or a spectral characteristic of a backlight.

Figure 3:
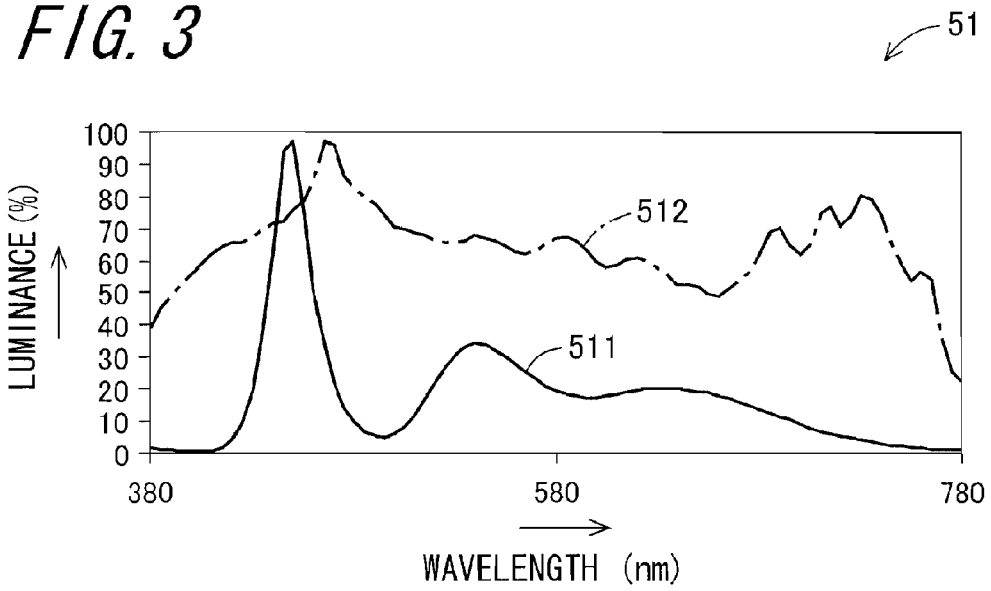
FIG. 3 is a graph showing an example of light source spectral luminance of external light and a backlight.

FIG. 3 is a graph 51 showing an example of light source spectral luminance of external light and a backlight. In the graph 51, luminance is on the ordinate and a wavelength (nm) is on the abscissa. The light source spectral luminance is spectral radiance of a light source such as external light and the backlight 13. The luminance is displayed in percentage (%) with respect to maximum luminance. The light source spectral luminance of a backlight is spectral radiance of a light source such as the backlight 13. The graph 51 shows light source spectral luminance 511 of the backlight which is luminance of irradiation light from the backlight 13 (hereinafter, simply referred to as luminance of a backlight) measured by the first spectral radiance sensor 16, and light source spectral luminance 512 of the external light which is luminance of external light measured by the second, spectral radiance sensor 18, which are measured within a wavelength range of 380 nm to 780 nm for each wavelength of 1 nm wavelength. For simplifying description, a spectral reflectivity of the half mirror 12 is assumed to be 100%, which is the same in the description below.

The light source spectral luminance 511 of the backlight represents luminance of external light at each wavelength, assuming that the maximum luminance among the backlight luminance measured for each wavelength is 100%. Additionally, the light source spectral luminance 512 of the external light represents luminance of external light at each wavelength, assuming that the maximum luminance among the external light luminance measured for each wavelength is 100%. The light source spectral luminance 512 of the external light is high luminance in a wide range with respect to the maximum luminance, however, the light source spectral luminance 511 of the backlight is low luminance within a range excluding a vicinity of the maximum luminance.

The CPU 30 generates a backlight spectral luminance matrix L1 and external light spectral luminance matrix L2. The backlight spectral luminance matrix L1 is a matrix expressing luminance for each wavelength represented by the light source spectral luminance 511 of the backlight measured by the first spectral radiance sensor 16. The external light spectral luminance matrix L2 is a matrix expressing luminance for each wavelength represented by the light source spectral luminance 512 of external light which is luminance of the external light measured by the second spectral radiance sensor 18. Specifically, each of the backlight spectral luminance matrix L1 and the external light spectral luminance matrix L2 is a matrix with 401 rows×1 column expressing luminance at a wavelength in increments of 1 nm wavelength within a wavelength range of 380 nm to 780 nm wavelength.

Figure 4:
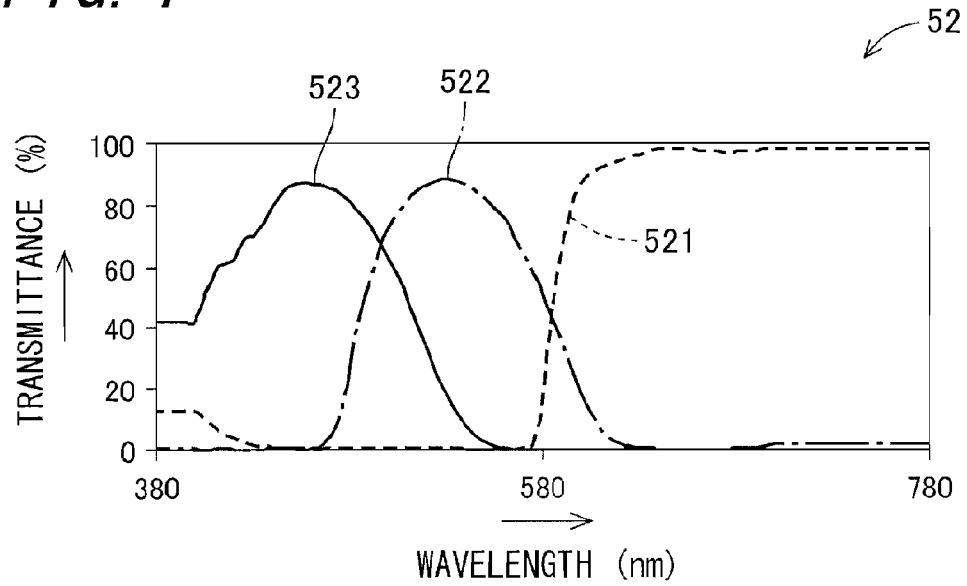
FIG. 4 is a graph showing an example of spectral transmittance of a color filter of an LCD module.

FIG. 4 is a graph 52 showing an example of spectral transmittance of a color filter of the LCD module 11. The transmittance is on the ordinate and a wavelength (nm) is on the abscissa. The graph 52 is a graph in which luminance of each of three colors composed of red, green and blue of RGB system into which white light allowed to pass through the color filter is separated is displayed in percentage (%) as transmittance for each wavelength of 1 nm wavelength within a wavelength range of 380 nm to 780 nm wavelength, assuming that luminance of the white light for irradiating the color filter is 100%.

Spectral transmittance 521 is transmittance of red light. Spectral transmittance 522 is transmittance of green light. Spectral transmittance 523 is transmittance of blue light. Spectral transmittance of the color filter of the LCD module 11 is measured in advance with a dedicated measurement device prior to incorporation into the apparatus, and the spectral transmittance of the color filter as the measured result is stored in a storage device (not shown) prior to factory shipment.

Immediately after the semi-transmissive liquid crystal display apparatus 1 is turned on, the CPU 30 reads the spectral transmittance of the color filter from the storage device (not shown) to generate a spectral transmittance matrix C. The spectral transmittance matrix C is a matrix expressing luminance for each wavelength represented by the spectral transmittance 521 of red light, the spectral transmittance 522 of green light, and the spectral transmittance 523 of blue light. Specifically, the spectral transmittance matrix C is a matrix with 401 rows and 3 columns expressing luminance at a wavelength in increments of 1 nm wavelength within the wavelength range of 380 nm to 780 nm wavelength in 3 columns in total which are 401 rows and 1 column for red light, 401 rows and 1 column for green light, and 401 rows and 1 column for blue light.

Figure 5:
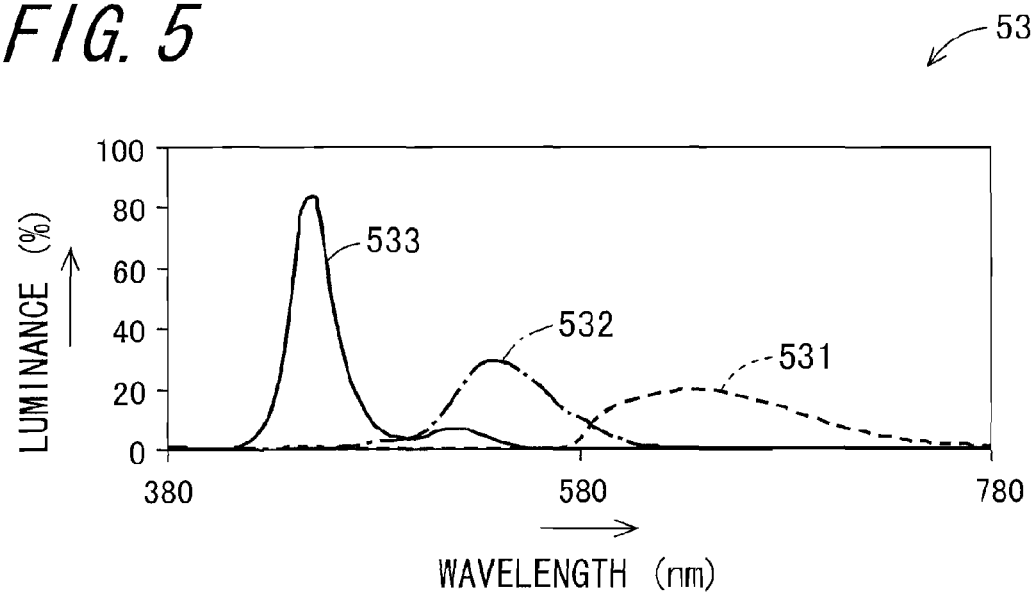
FIG. 5 is a graph showing an example of a spectral characteristic of irradiation light of the backlight at the time of transmittance of a color filter.

FIG. 5 is a graph 53 showing an example of a spectral characteristic of irradiation light of the backlight 13 at the time of transmittance of a color filter. Luminance is on the ordinate and a wavelength (nm) is on the abscissa. The graph 53 is a graph in which luminance of each of three colors composed of red, green and blue into which irradiation light of the backlight 13 allowed to pass through the color filter is separated is displayed in percentage (%) for each wavelength of 1 nm wavelength, within a wavelength range of 380 nm to 780 nm wavelength, assuming that luminance of the white light for irradiating the color filter is 100%.

A spectral characteristic 531 is a characteristic of red light. A spectral characteristic 532 is a characteristic of green light. A spectral characteristic 533 is a characteristic of blue light.

The spectral characteristic 531 of red light, the spectral characteristic 532 of green light, and the spectral characteristic 533 of blue light in the graph 53 are able to be obtained from the light source spectral luminance 511 of the backlight shown in FIG. 3, the spectral transmittance 521 of red light, the spectral transmittance 522 of green light and the spectral transmittance 523 of blue light shown in FIG. 4. Specifically, the CPU 30 obtains a matrix in which respective matrix elements of the backlight spectral luminance matrix L1 and the spectral transmittance matrix C are multiplied by one another, that is a matrix of an operation result of L1×C. Values of the matrix as the operation result of L1×C are plotted as shown in the graph 53.

Figure 6:
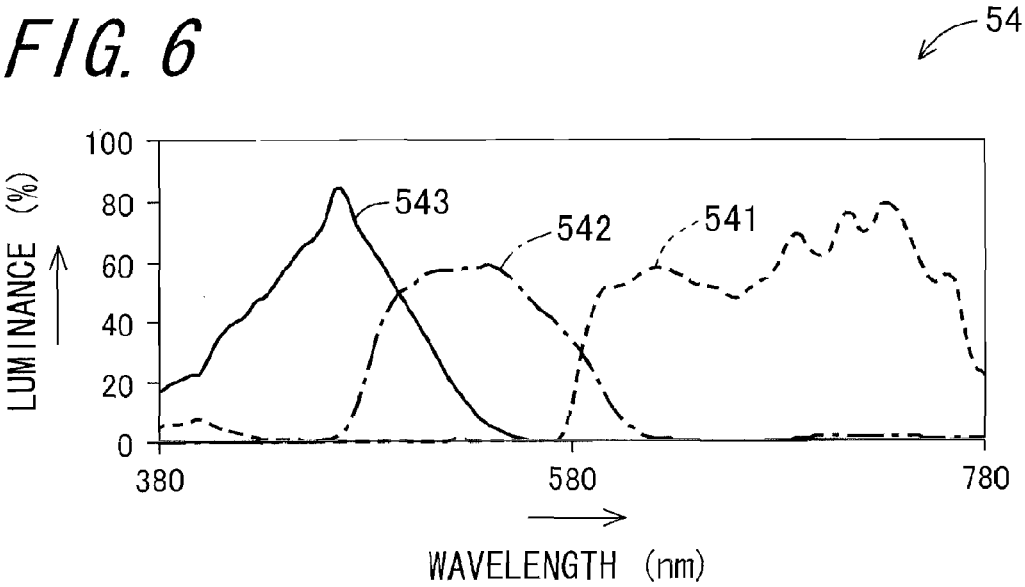
FIG. 6 is a graph showing an example of a spectral characteristic of external light at the time of transmittance of a color filter.

FIG. 6 is a graph 54 showing an example of a spectral characteristic of external light at the time of transmittance of a color filter. Luminance is on the ordinate and a wavelength (nm) is on the abscissa. The graph 53 is a graph in which luminance of each of three colors composed of red, green and blue into which external light allowed to pass through the color filter is separated is displayed in percentage (%) for each wavelength of 1 nm wavelength within a wavelength range of 380 nm to 780 nm wavelength, assuming that luminance of white light for irradiating the color filter is 100%.

A spectral characteristic 541 is a characteristic of red light. A spectral characteristic 542 is a characteristic of green light. A spectral characteristic 523 is a characteristic of blue light.

The spectral characteristic 541 of red light, the spectral characteristic 542 of green light, and the spectral characteristic 543 of blue light in the graph 54 are able to be obtained from the light source spectral luminance 512 of external light shown in FIG. 3, the spectral transmittance 521 of red light, the spectral transmittance 522 of green light and the spectral transmittance 523 of blue light shown in FIG. 4. Specifically, the CPU 30 obtains a matrix in which respective matrix elements of the external light spectral luminance matrix L2 and the spectral transmittance matrix C are multiplied by one another, that is a matrix of an operation result of L2×C. Values of the matrix as the operation result of L2×C are plotted as shown in the graph 54.

Figure 7:
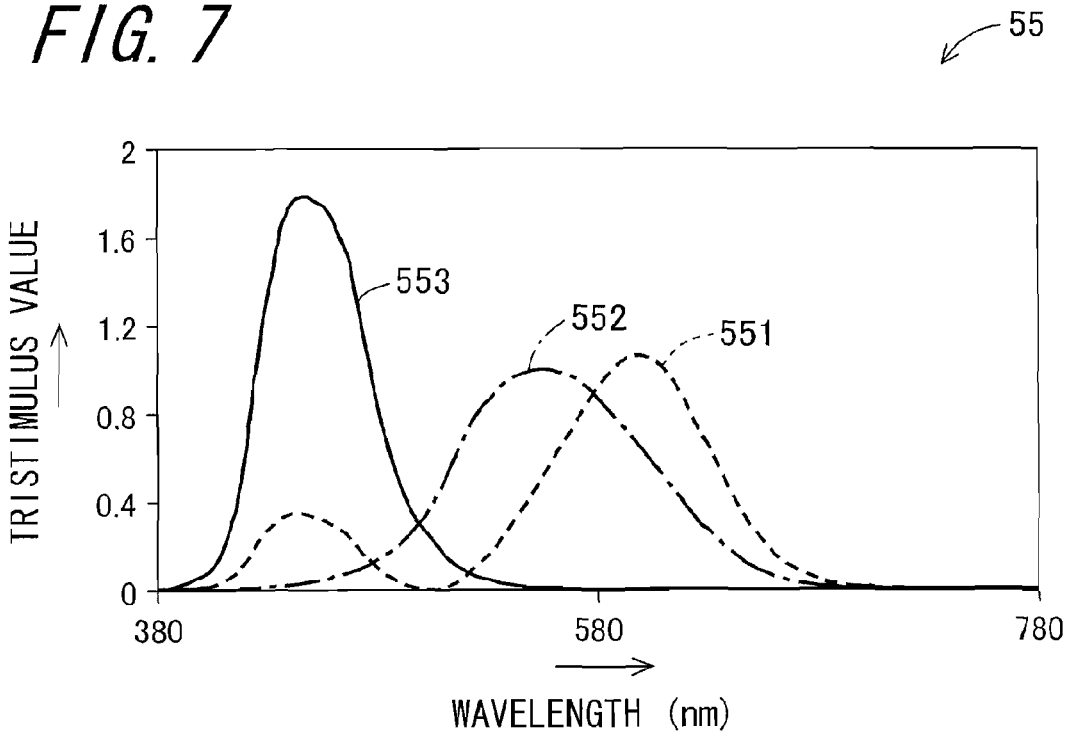
FIG. 7 is a graph showing a luminous sensitivity characteristic of a color-matching function.

FIG. 7 is a graph 55 showing a luminous sensitivity characteristic of a color-matching function. A tristimulus value is on the ordinate and a wavelength (nm) is on the abscissa. The color-matching function shown in FIG. 7 is a color-matching function of XYZ colorimetric system, and a color-matching function of a standard colorimetric observer specified in the specification of CIE (Commission Internationale de l'Eclairage) 1931, and the function specified by a luminous sensitivity characteristic with 2°-field of vision.

A luminous sensitivity characteristic 551 of red light is a luminous sensitivity characteristic having two peaks in a convex shape in which the tristimulus value becomes about 0.4 at the maximum in the vicinity of the wavelength of about 430 nm within the wavelength range of about 400 nm to 500 nm, and in a convex shape in which the tristimulus value becomes about 1.1 at the maximum in the vicinity of the wavelength of about 590 nm within the wavelength range of about 500 nm to 680 nm. A luminous sensitivity characteristic 552 of green light is a luminous sensitivity characteristic having a convex shape in which the tristimulus value become about 1.0 at the maximum in the vicinity of the wavelength of about 560 nm within the wavelength range of about 420 nm to 680 nm. A luminous sensitivity characteristic 553 of blue light is a luminous sensitivity characteristic having a convex shape in which the tristimulus value become about 1.8 at the maximum in the vicinity of the wavelength of about 450 nm within the wavelength range of about 380 nm to 550 nm.

The CPU 30 generates a color-matching function matrix S expressing a color-matching function. Specifically, immediately after the display apparatus is turned on, the CPU 30 reads a luminous sensitivity characteristic of a color-matching function from the storage device (not shown), and based on the read luminous sensitivity characteristic of the color-matching function, generates the color-matching function matrix S. The color-matching function matrix S is a matrix expressing a tristimulus value for each wavelength represented by the luminous sensitivity characteristic 551 of red light, the luminous sensitivity characteristic 552 of green light and the luminous sensitivity characteristic 553 of blue light. The color-matching function matrix S is a matrix with 401 rows and 3 columns expressing luminance at a wavelength in increments of 1 nm wavelength within the wavelength range of 380 nm to 780 nm wavelength in 3 columns in total which are 401 rows and 1 column for red light, 401 rows and 1 column for green light, and 401 rows and 1 column for blue light.

A color signal of image information inputted from the input terminal 31 is expressed with a function f(R,G,B) in RGB system, a color signal expressed by the function f(R,G,B) whose color is produced with irradiation light by the backlight 13 is expressed with a function g1(X,Y,Z) in XYZ colorimetric system, and a conversion matrix thereof is expressed by M, relation of formula (1) is formed.

$$g1(X,Y,Z)=f(R,G,B)\cdot M \tag{1}$$

Wherein, "·" is an operation symbol representing multiplication of matrices. Similarly, when the color signal expressed by the function f(R,G,B) whose color is produced with external light is expressed with a function g2(X,Y,Z) in XYZ colorimetric system, and a conversion matrix thereof is expressed by N, relation of formula (2) is formed.

$$g2(X,Y,Z)=f(R,G,B)\cdot N \tag{2}$$

The conversion matrix M is expressed by formula (3) using the color-matching function matrix S and the conversion matrix N is expressed by formula (4) using the color-matching function matrix S.

$$M=(S^t\cdot L1\times C)^t \tag{3}$$

$$N=(S^t\cdot L2\times C)^t \tag{4}$$

Wherein, "x" is an operation symbol representing multiplication of elements of the matrices. Additionally, "$^t$" is an operation symbol representing a transposed matrix. Each of the conversion matrices M and N is a matrix with 3 rows and 3 columns.

When the function g2(X,Y,Z) expressing a color signal at the time of producing color with external light is brought to conform to the function g1(X,Y,Z) expressing a color signal at the time of producing color with irradiation light by the backlight 13, the color signal at the time of producing color with external light conforms the color signal at the time of producing color with the irradiation light by the backlight 13. When a correction matrix for bringing the function g2(X,Y,Z) expressing a color signal at the time of producing color with external light to conform to the function g1(X,Y,Z) is assumed to be A, relation of formula (5) is formed.

$$g2(X,Y,Z)\cdot A=g1(X,Y,Z) \tag{5}$$

When each term on each of both sides of the formula (2) is multiplied by a matrix ($N^{-1}\cdot M$) from the right side, the formula (2) becomes formula (6). Wherein, "$^{-1}$" is an operation symbol representing an inverse matrix.

$$\begin{aligned} g2(X,Y,Z)\cdot N^{-1}\cdot M &= f(R,G,B)\cdot N\cdot N^{-1}\cdot M \\ &= f(R,G,B)\cdot M \end{aligned} \tag{6}$$

From the formula (1), it is possible to deform the formula (6) to formula (7).

$$g2(X,Y,Z)=N^{-1}\cdot M=g1(X,Y,Z) \tag{7}$$

From the formula (5) and the formula (7), for the correction matrix A, $A=N^{-1}\cdot M$.

The CPU 30 transmits the correction matrix A to the video image signal processing section 33 as parameter information. The video image signal processing section 33 performs color correction based on the received parameter information. Specifically, the video image signal processing section 33 multiplies each pixel constituting an image shown by image information by the correction matrix A from the right side so as to perform color correction.

Figure 8A:
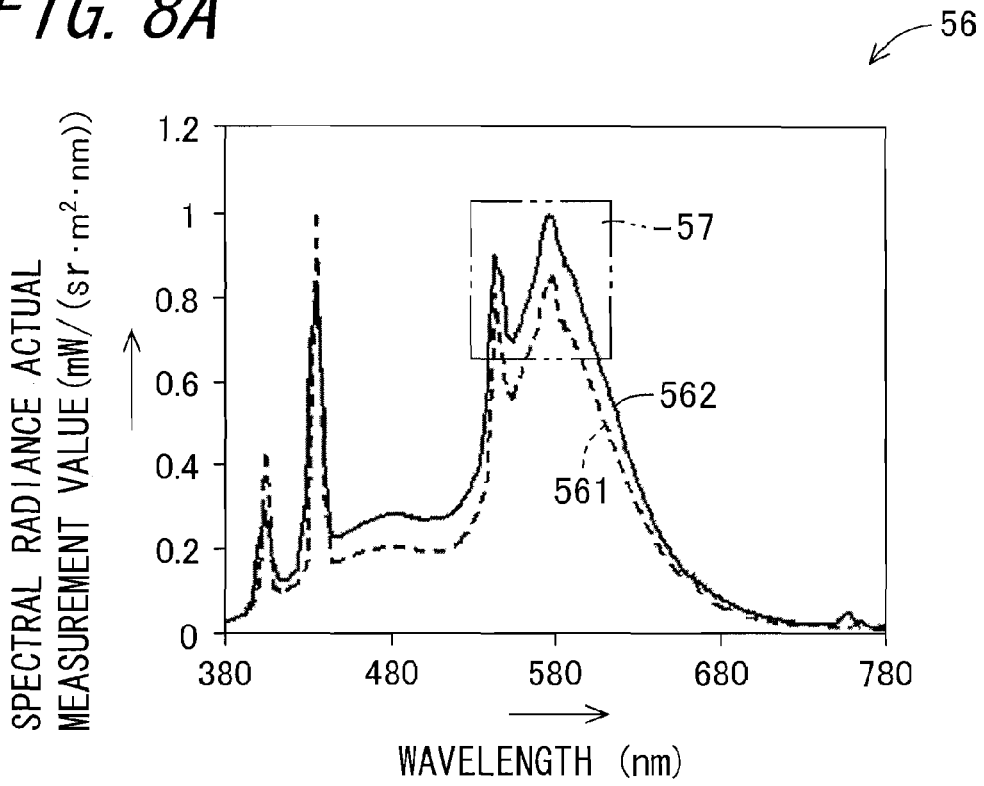
FIG. 8A is a view for explaining an evaluation method for detecting change of external light.
Figure 8B:
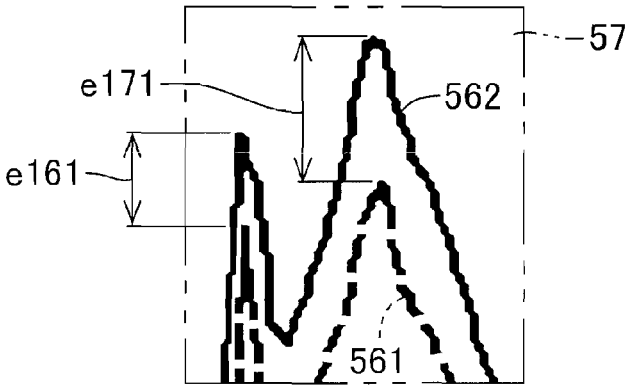
FIG. 8B is a view for explaining an evaluation method for detecting change of external light.

FIGS. 8A and 8B are views for explaining an evaluation method for detecting change of external light. A spectral radiance actual measurement value ($mW/(sr \cdot m^2 \cdot nm)$) is on the ordinate and a wavelength (nm) is on the abscissa.

FIG. 8A shows a spectral radiance 561 representing luminance at a time point t1 for each wavelength, and a spectral radiance 562 representing luminance at a time point t2 for each wavelength. FIG. 8B shows an enlarged view of a portion in a range 57 of the spectral radiance 561 and the spectral radiance 562 shown in FIG. 8A. The time point t2 is a time point, for example, after a first time, from the time point t1.

A difference between the spectral radiance at the time point t2 and the spectral radiance at the time point t1 is assumed to be expressed by an average (hereinafter, referred to as "arithmetic average") en of a total of differences (absolute values) at each wavelength in increments of 1 nm wavelength in a zone of the wavelength of 380 nm to 780 nm. That is, when the difference (absolute value) between luminance values at respective wavelengths is represented by ei (i=1 to 401), the arithmetic average en is expressed by formula (8).

$$en = \sum_{i=1}^{401} ei/401 \tag{8}$$

FIG. 8B shows a difference e161 at a wavelength of 161 nm and a difference e171 at a wavelength of 171 nm as representatives.

The CPU 30 detects spectral radiance of external light for each first time interval, for example, per hour, and when the arithmetic average en is 10% or more of a first evaluation determination value which is a first threshold, for example, maximum luminance at the time point t1, determines that the external light has changed, and newly calculates parameter information for transmitting the calculated parameter information to the video image signal processing section 33 so as to cause color correction to be performed based on the parameter information.

Since the CPU 30 operates the correction matrix only when the arithmetic average en is greater than or equal to the first evaluation determination value, there is no need to generate parameter information every time, so that processing time is able to be shortened when there is no need to operate the correction matrix.

Further, the CPU 30 detects the spectral radiance of external light for each first time interval, and converts the detected spectral radiance of external light ($W/(sr \cdot m^2 \cdot nm)$) to a luminance value ($cd/m^2$). When a ratio of the value to a value of conversion from the spectral radiance to the luminance value of the backlight is greater than or equal to a second evaluation determination value, for example, a ratio in which luminance of external light is twice or more of the backlight luminance, the backlight 13 is turned off so that display is performed only with the external light. When a ratio of a luminance value of the external light to a luminance value of the backlight is less than the second evaluation determination value, the backlight 13 is turned on so that display is performed with the external light and the irradiation light of the backlight 13. The conversion from the spectral radiance to the luminance value is obtained from a value of integral of the spectral radiance in 380 nm to 780 nm.

Figure 9:
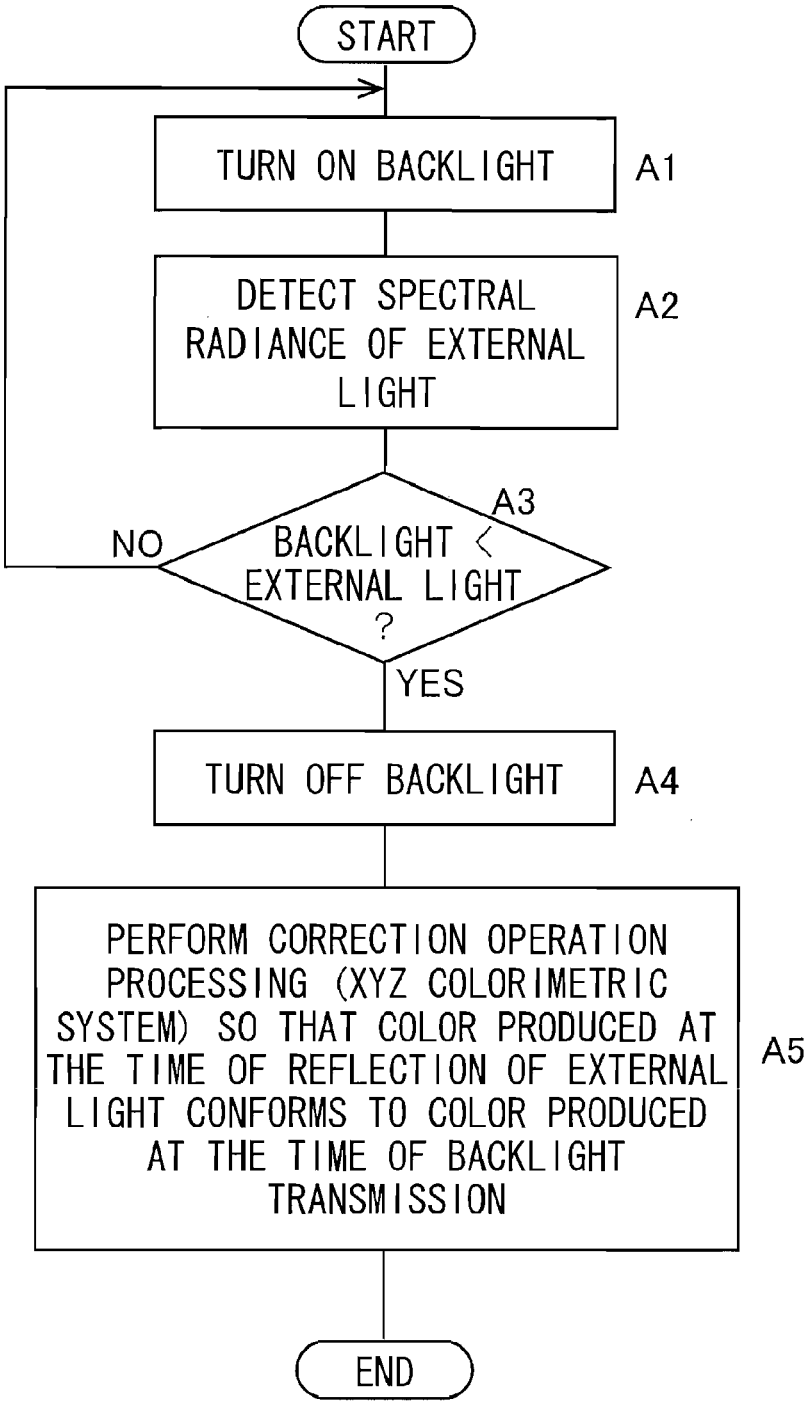
FIG. 9 is a flowchart showing processing procedure of first color correction processing for performing color correction by turning off the backlight.

FIG. 9 is a flowchart showing processing procedure of first color correction processing for performing color correction by turning off the backlight 13. The first color correction processing is processing in a case where whether or not display is performed only with external light is switched according to the luminance of the external light. When the semi-transmissive liquid crystal display apparatus 1 is turned on to be in an operable state, the CPU 30 is operated so that the procedure goes to step A1. Further, also in the case where spectral radiance of the external light becomes less than the spectral radiance of a backlight at a time point of factory shipment, the procedure goes to step A1.

At step A1, the CPU 30 instructs the liquid crystal panel/light source section 35 to turn on the backlight 13 so that the backlight 13 is turned on. At step A2, the CPU 30 detects spectral radiance of external light with the second spectral radiance sensor 18 for each first time interval. At step A3, when the spectral radiance of external light is greater than the spectral radiance of backlight at the time point of factory shipment, the CPU 30 is operated so that the procedure proceeds to step A4. When the spectral radiance of the external light is less than or equal to the spectral radiance of the backlight at the time point of factory shipment, the procedure returns to step A1.

At step A4, the CPU 30 instructs the liquid crystal panel/light source section 35 to turn off the backlight 13 so that the backlight 13 is turned off. At step A5, the CPU 30 performs correction operation processing of XYZ colorimetric system, that is, generation of parameter information so that color produced with external light, namely, color produced with reflection light of external light with the half mirror 12 conforms to color produced only with irradiation light of the backlight 13. The generated parameter information is then transmitted to the video image signal processing section 33 so as to cause color correction to be performed based on the parameter information to finish the first color correction processing.

Figure 10:
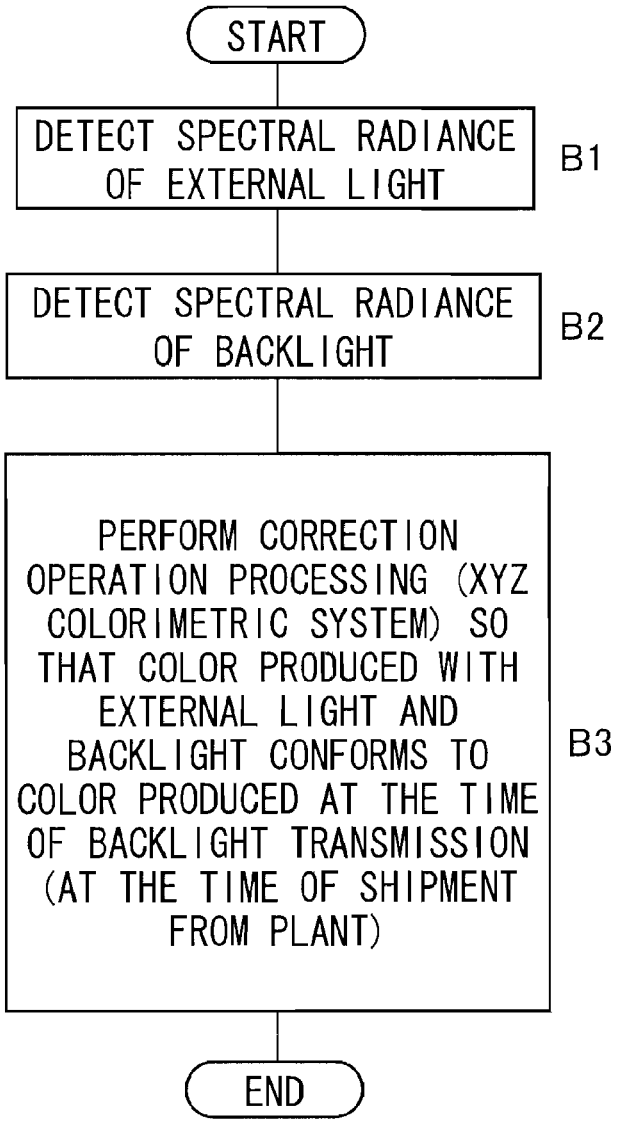
FIG. 10 is a flowchart showing processing procedure of second color correction processing for performing color correction using the backlight in combination with external light.

FIG. 10 is a flowchart showing processing procedure of second color correction processing for performing color correction using the backlight 13 in combination with external light. The second color correction processing is processing in the case where without depending on luminance of external light, the backlight 13 is used in combination therewith all the time. When the semi-transmissive liquid crystal display apparatus 1 is turned on to be in an operable state, the CPU 30 is operated so that the procedure goes to step B1. Further, every time after the first time, the procedure goes to step B1.

At step B1, the CPU 30 detects the spectral radiance of the external light with the second spectral radiance sensor 18. At step B2, the CPU 30 detects the spectral radiance of the backlight with the first spectral radiance sensor 16. At step B3, the CPU 30 performs correction operation processing of XYZ colorimetric system, that is, generation of parameter information so that color produced when external light is used in combination with the backlight 13 conforms to color produced only with irradiation light of the backlight 13 at the time point of factory shipment. The generated parameter information is then transmitted to the video image signal processing section 33 so as to cause color correction to be performed based on the parameter information to finish the second color correction processing.

In this case, the formula (4) described above is caused to be expressed as formula (9) by using the backlight spectral luminance matrix L1 and the external light spectral luminance matrix L2.

$$N^n = (S^t \cdot (L1 + L2) \times C)^t \tag{9}$$

As a result, a correction matrix $A'=N'^{-1}\cdot M$ is derived. Wherein, "+" is an operation symbol representing addition of matrices.

In considering temporal change of the backlight 13, for the backlight 13, the CPU 30 detects spectral radiance with the first spectral radiance sensor 16 at a predetermined time point, for example, at a time point of factory shipment, as well as for each second time interval after the predetermined time point, for example, for each month. Then, it is determined that there has been temporal change in the backlight 13 when the arithmetic average en is 10% or more of a third evaluation determination value which is a second threshold, for example, maximum luminance at the time point of factory shipment. In the case of determination that there has been temporal change in the backlight 13, the CPU 30 generates a correction matrix B for correcting color shift along with the temporal change in the backlight 13 based on the detected spectral radiance of the backlight and the spectral radiance of the backlight at the time point of factory shipment. With the temporal change of the backlight, when change from L1 to L1' is assumed to occur, the above-described formula (3) is deformed so that a correction matrix M' in formula (10) is also considered.

$$M'=(S^t\cdot L1'\times C)^t \tag{10}$$

As the result, for the correction matrix B considering the temporal change, $B=N^{-1}\cdot M'^{-1}\cdot M$. At step B3, the CPU 30 transmits the temporal change correction matrix B to the video image signal processing section 33 as parameter information so that color correction is caused to be performed based on the parameter information, thereby finishing the second color correction processing.

Figure 11:
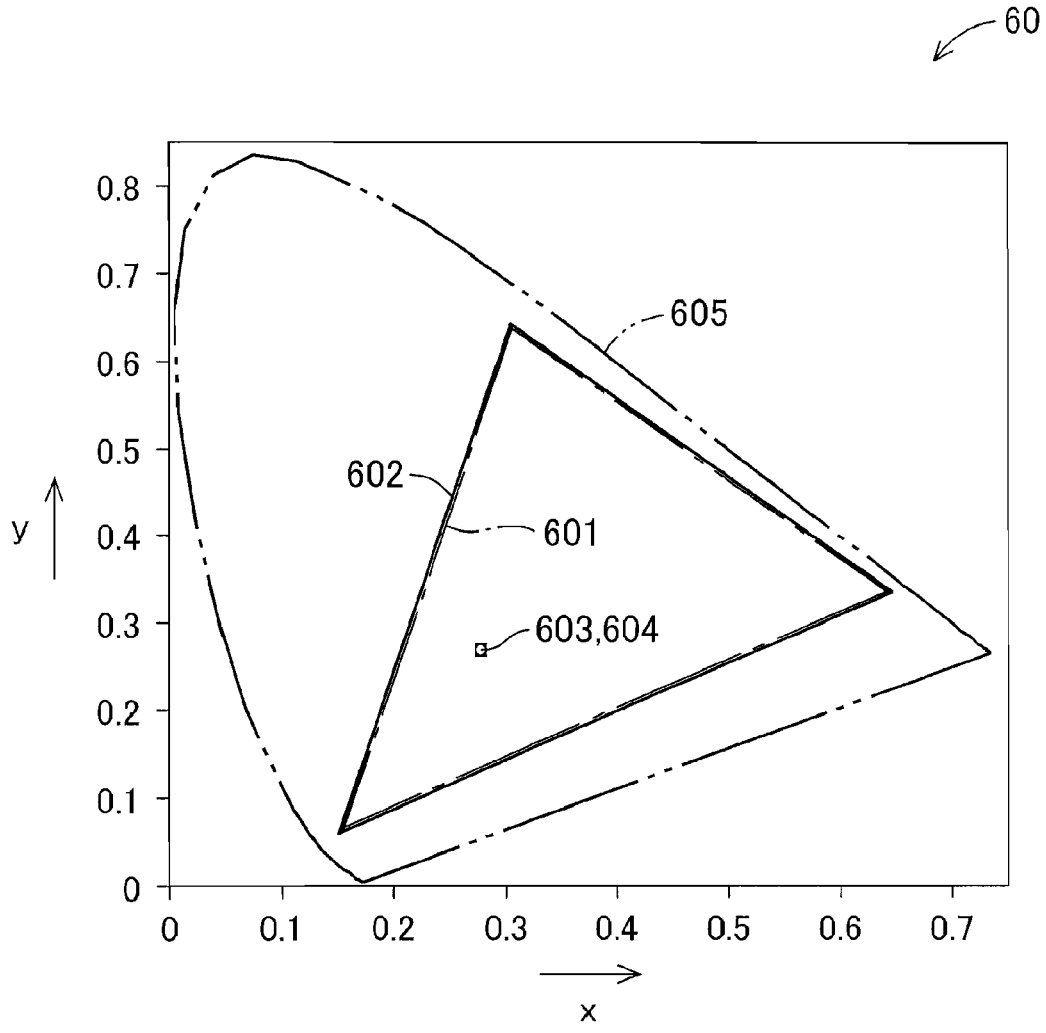
FIG. 11 shows xy chromaticity at the time of performing color correction with the semi-transmissive liquid crystal display apparatus.

FIG. 11 shows xy chromaticity 60 at the time of performing color correction with the semi-transmissive liquid crystal display apparatus 1. The xy chromaticity 60 is xy chromaticity in XYZ colorimetric system which is specified by CIE, and y chromaticity of the xy chromaticity is on the ordinate and x chromaticity of the xy chromaticity is on the abscissa. Color gamut 605 is color gamut of a color-matching function according to CIE1931.

Color gamut 601 is color gamut at the time of performing color correction to color produced with external light in the semi-transmissive liquid crystal display apparatus 1, and color gamut 602 is color gamut in producing color only with a backlight 13. A border line of the color gamut 601 coincides with a border line of the color gamut 602 so as to be overlapped actually, however, displaced to be shown in FIG. 12 for facilitating understanding. Further, white point 603 when color correction is performed for producing color with external light in the semi-transmissive liquid crystal display apparatus 1 coincides with white point 604 with only the backlight 13.

Figure 12:
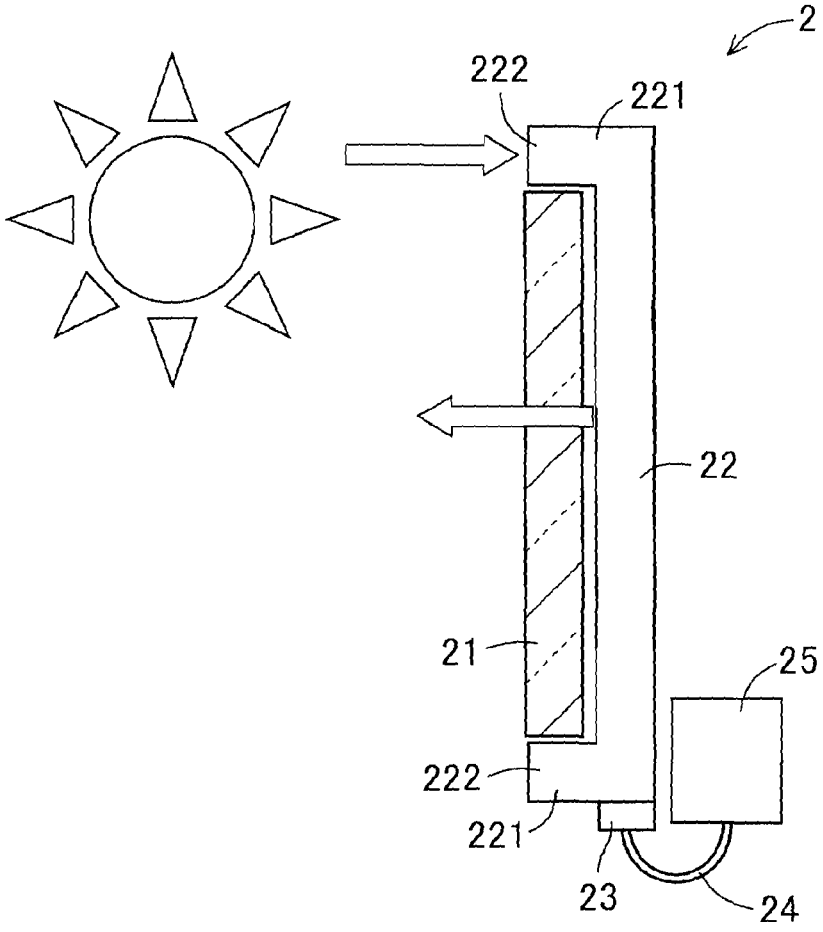
FIG. 12 is a side view schematically showing external appearance of a transmissive liquid crystal display apparatus according to a second embodiment of the invention.

FIG. 12 is a side view schematically showing external appearance of a transmissive liquid crystal display apparatus 2 according to a second embodiment of the invention. The transmissive liquid crystal display apparatus 2, which is a display apparatus, comprises an LCD module 21, a backlight 22, a diffuser plate 23, optical fiber 24 and a spectral radiance sensor 25. The LCD module 21, the diffuser plate 23, and the optical fiber 24 and the spectral radiance sensor 25 have the same configuration respectively as the LCD module 11, the diffuser plate 14, the optical fiber 15 and the first spectral radiance sensor 16 as shown in FIG. 1A, and description thereof is omitted for avoiding redundancy.

The backlight 22 is composed of, for example, an edge light-type backlight, and comprises a light source (not shown) and a light guide plate (not shown). The backlight 22 has at a peripheral section 221 of the backlight 22 an external light intake 222 for taking in external light coming from the front side of the LCD module 21. External light taken in from the external light intake 222, which is an external light acquisition section, is supplied to a light guide plate. Further, irradiation light emitted from a light source of the backlight 22 is also supplied to the light guide plate. The backlight 22 emits the external light taken in from the external light intake 222 and the irradiation light emitted by the light source from the light guide plate so as to be passed through from the back of the LCD module 21 to the front side of the LCD module 21. The external light taken in from the external light intake 222 is acquired external light.

The diffuser plate 23 is disposed below the backlight 22 in a surface direction of the screen of the LCD module 21, and connected to the light guide plate. The diffuser plate 23 diffuses and transmits the external light emitted from the light guide plate and taken in from the external light intake 222 and the irradiation light emitted from the light source so that the external light and the irradiation light are supplied to the optical fiber 24. The spectral radiance sensor 25 detects spectral characteristics of the external light and the irradiation light supplied from the optical fiber 24.

The configuration of the transmissive liquid crystal display apparatus 2 is the same as the configuration of the semi-transmissive liquid crystal display apparatus 1 shown in FIG. 2 except what is described below. The transmissive liquid crystal display apparatus 2 uses the spectral radiance sensor 25 in place of the first spectral radiance sensor 16 and the second spectral radiance sensor 18 shown in FIG. 2. Further, the liquid crystal panel/light source section 35 comprises the LCD module 21 and the backlight 22 shown in FIG. 12 without including the half mirror 12.

The CPU 30 performs the same processing as the second color correction processing as shown in FIG. 10, therefore description thereof is omitted for avoiding redundancy. Further, in measuring spectral radiance of external light, it is also possible to turn off the backlight 22 and detect spectral radiance of only external light so that it is possible to perform the same processing as the first color correction processing.

Compared to the semi-transmissive liquid crystal display apparatus 1 shown in FIG. 1A, the transmissive liquid crystal display apparatus 2 shown in FIG. 12 has no half mirror 12, in which the number of the spectral radiance sensors to be provided are changed from two to one, thereby allowing to realize an apparatus with less number of parts with lower costs.

Further, according to the half mirror 12 shown in FIG. 1A, external light attenuates due to the LCD module 11 so that reflection light of external light by the half mirror 12 is weak, however, in the transmissive liquid crystal display apparatus 2 shown in FIG. 12, the external light intake 222 is provided so that the external light itself is able to be used as backlight, it is thereby possible to supply the stronger light than the reflection light of the external light by the half mirror 12 to the LCD module 21.

In the above-described embodiment, the arithmetic average is used to detect change of external light and temporal change of the backlight 13, however, it is also possible to make determination based on luminance at a representative wavelength such as the wavelength of 550 nm.

In this manner, when irradiation light caused by irradiation of the backlight 13 disposed at the back side of the LCD module 11, which is the opposite side of the display screen displaying image information; and reflection light of external light by the half mirror 12 disposed between the LCD module 11 and the backlight 13 or acquired external light acquired by the external light intake 222 disposed at the peripheral section of the LCD module 11; or the reflection light or the acquired external light is allowed to pass through the color filter disposed at the LCD module 11 to produce color of image information, the first spectral radiance sensor 16 and the second spectral radiance sensor 18 detect a spectral characteristic which is represented as luminous energy of the irradiation light and luminous energy of external light irradiating the LCD module 11 from outside at a predetermined wavelength interval within a predetermined wavelength range. The video image signal processing section 33 performs color correction of the image information to be displayed on the LCD module 11, and supplies the image information subjected to the color correction to the LCD module 11 for display. Then the CPU 30 causes the first spectral radiance sensor 16 and the second spectral radiance sensor 18 to detect the spectral characteristics of the luminous energy of the irradiation light and the spectral characteristics of the luminous energy of the external light, generates parameter information based on the spectral characteristics of the irradiation light and the spectral characteristics of external light which are caused to be detected by the first spectral radiance sensor 16 and the second spectral radiance sensor 18, and supplies the generated parameter information to the video image signal processing section 33 so as to cause the video image signal processing section 33 to perform color correction of image information to be displayed based on the supplied parameter information. In the case of the transmissive liquid crystal display apparatus 2, the LCD module 11 is the LCD module 21, the backlight 13 is the backlight 22, the first spectral radiance sensor 16 and the second spectral radiance sensor 18 are the spectral radiance sensor 25, which are the same in the following description.

Therefore, it is possible to correct color shift due to an effect of external light and the like. Especially, in digital signage using the display apparatus, for example, the semi-transmissive liquid crystal display apparatus 1 or the transmissive liquid crystal display apparatus 2 capable of achieving high luminance with acquired external light, spectral characteristics of external light and irradiation light from the backlight 13 are detected by the spectral characteristic detection section such as a spectral luminance sensor, color correction is performed based on the detected spectral characteristics so that deterioration in visibility due to an effect of external light or temporal change of the backlight 13 is prevented, and allowing to mend the problem of color shift and shortage of luminance in the backlight irradiation mode, the external light mode, and the backlight irradiation and external light mode in the semi-transmissive liquid crystal display apparatus 1 or the transmissive liquid crystal display apparatus 2.

Moreover, even in either one of a case of placing outdoors subjected to an effect of external light and a case of placing indoors depending on backlight irradiation, there occurs no color shift even when the same image is displayed, so that an observer will not be given a sense of discomfort in color reproducibility, and it is possible to achieve a display apparatus capable of being used both for placing outdoors and for placing indoors.

Further, the CPU 30 calculates a correction matrix for color correction based on the spectral characteristics of the irradiation light and the spectral characteristics of the external light detected by the first spectral radiance sensor 16 and the second spectral radiance sensor 18, the spectral transmittance of the color filter disposed at the module 11, as well as the color-matching function to define the calculated correction matrix as parameter information. Accordingly, the correction matrix which is the parameter information capable of performing correction of color shift more accurately is able to be calculated.

Further, the CPU 30 causes the second spectral radiance sensor 18 to detect spectral characteristics of external light irradiating the LCD module 11 from outside for each first time interval. Then, when a difference of the spectral characteristic of the external light between a start time point of the first time and a time point after the first time is greater than or equal to a first threshold, the CPU 30 generates parameter information. Therefore, when the degree of color shift of display color is small which is caused by deterioration in performance along with temporal change of the external light, it is possible to omit operation processing for performing the color correction, which thereby not causing delay in screen display.

Further, the CPU 30 causes the first spectral radiance sensor 16 to detect the spectral characteristic of the irradiation light from the backlight 13 at each predetermined time point and for each second time interval after the predetermined time point. Then, when the difference between the spectral characteristic at the predetermined time point and the spectral characteristic at the second time interval is greater than or equal to a second threshold, based on the spectral characteristic at the predetermined time point and the spectral characteristics at the second time interval, the CPU 30 generates color correction information for bringing color of image information produced by irradiation light of the spectral characteristic which is the second threshold to conform to color of image information produced with irradiation light at the predetermined time point, and supplies the generated color correction information to the video image signal processing section 33.

Therefore, even when there occurs change due to temporal change in irradiation light by the backlight 13 used in the display apparatus, color correction for the temporal change is performed so that color shift due to deterioration in performance of the backlight 13 is suppressed, thereby making it possible to maintain display of color produced in a condition which is equivalent to that at the time of factory shipment of the display apparatus.

Moreover, when luminous energy shown by the spectral characteristic of external light detected by the second spectral radiance sensor 18 is less than the luminous energy shown by the spectral characteristic of irradiation light detected by the first spectral radiance sensor 16, the CPU 30 causes the backlight 13 to perform irradiation with irradiation light. Then, based on the spectral characteristic of the irradiation light and the spectral characteristic of the external light detected by the first spectral radiance sensor 16 and the second spectral radiance sensor 18, the CPU 30 generates parameter information for bringing color of image information produced when the irradiation light and the reflection light or the acquired external light are allowed to pass through the color filter to conform to color of image information produced when only the irradiation light from the backlight 13 is allowed to pass through the color filter.

Therefore, when there is a shortage of luminance in external light, the luminance is supplemented with the irradiation light by the backlight 13, so that it is possible to produce color of image information with light combining the irradiation light by the backlight 13 and the external light. Color correction is performed by obtaining parameter information for performing color correction, for example, a correction matrix, based on the spectral characteristics of the irradiation light by the backlight 13 and the external light, so that it is possible to obtain display of color produced which is equivalent to that with only the irradiation light by the backlight 13.

Figure 13A:
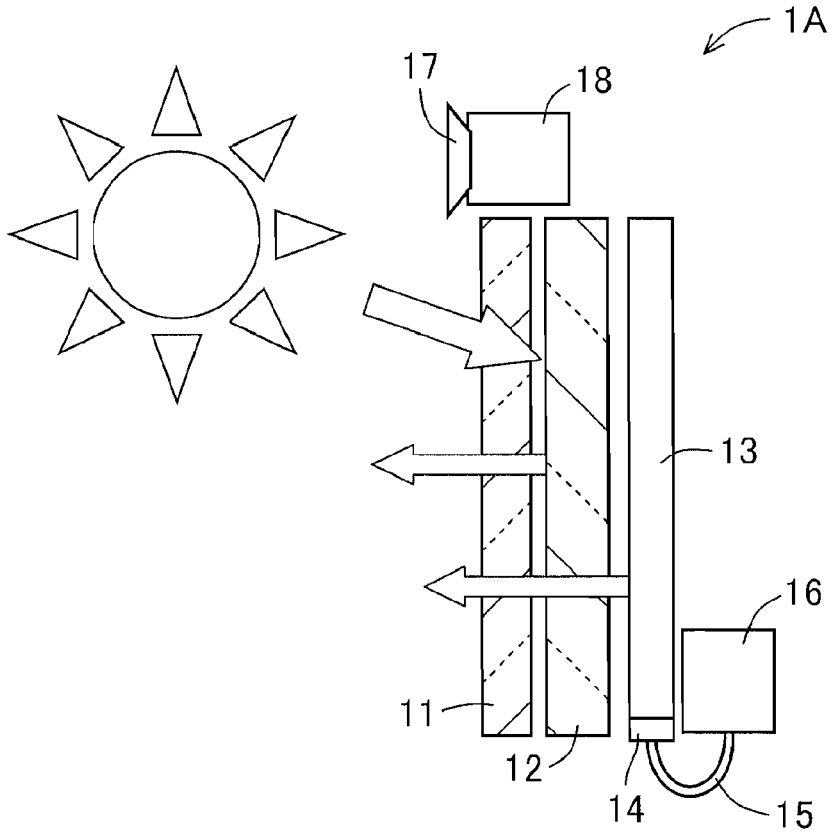
FIG. 13A is a side view schematically showing external appearance of a semi-transmissive liquid crystal display apparatus according to a third embodiment of the invention.
Figure 13B:
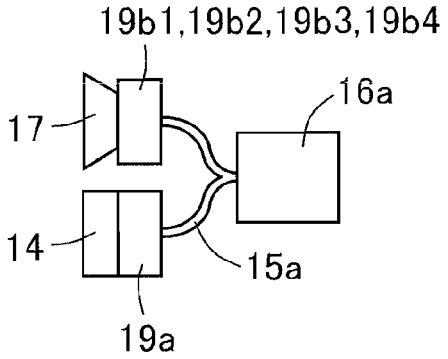
FIG. 13B is a side view schematically showing external appearance of a semi-transmissive liquid crystal display apparatus according to the third embodiment of the invention.
Figure 14A:
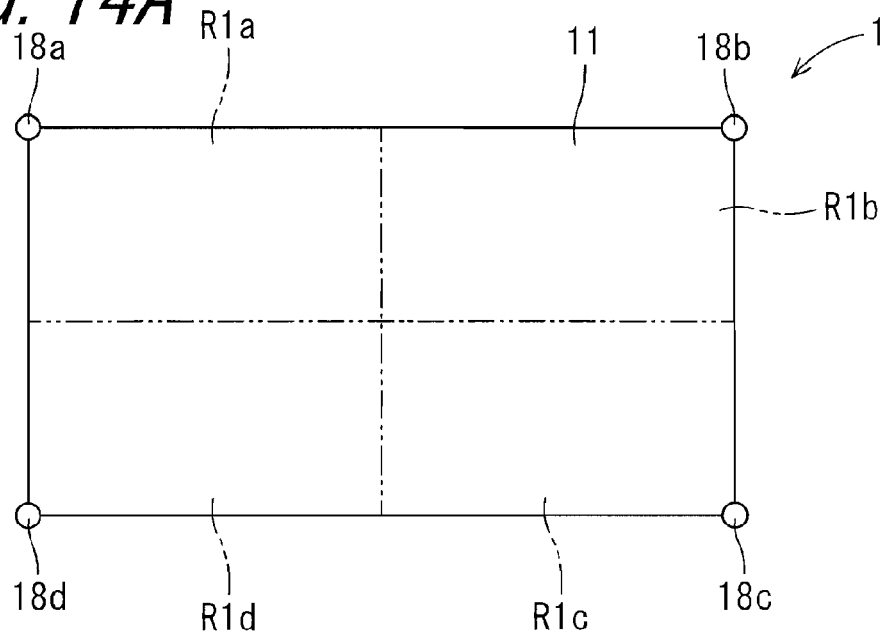
FIG. 14A is a front view schematically showing external appearance of the semi-transmissive liquid crystal display apparatus.
Figure 14B:
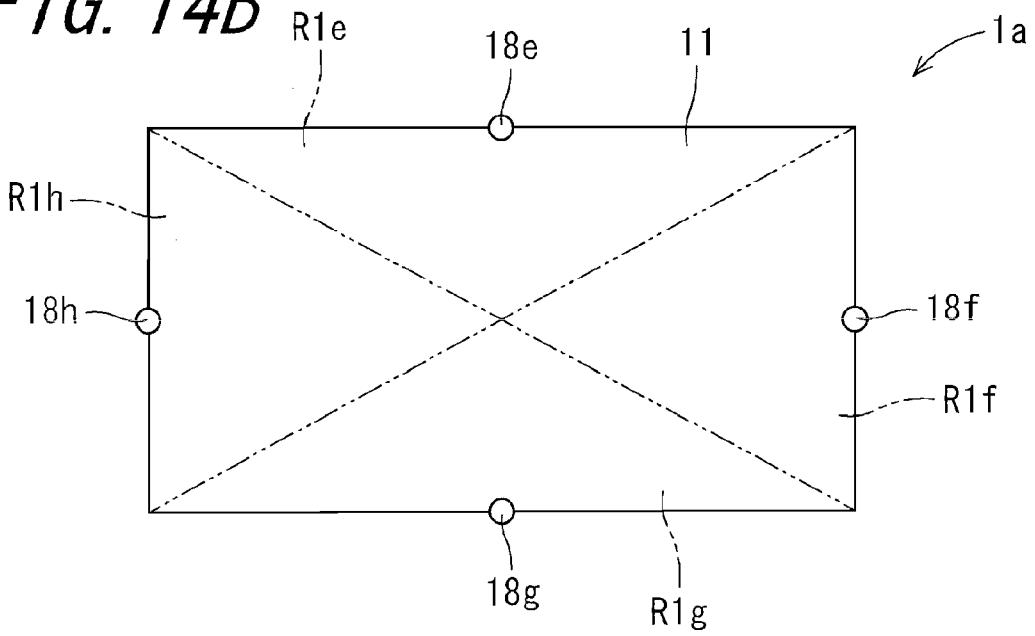
FIG. 14B is a front view schematically showing external appearance of the semi-transmissive liquid crystal display apparatus.

FIGS. 13A and 13B are side views schematically showing external appearance of a semi-transmissive liquid crystal display apparatus 1A according to a third embodiment of the invention. FIGS. 14A and 14B are front views schematically showing external appearance of the semi-transmissive liquid crystal display apparatuses 1A and 1B. FIG. 13A shows external appearance of the semi-transmissive liquid crystal display apparatus 1A seen from a lateral side. In the embodiment, corresponding parts of the configuration in the above-described embodiment are denoted by the same reference numerals, and description thereof is omitted. The semi-transmissive liquid crystal display apparatus 1A, which is a display apparatus, comprises the liquid crystal display (abbreviated as LCD) module 11, the half mirror 12, the backlight 13, the diffuser plates 14 and 17, the optical fiber 15, the first spectral radiance sensor 16, and the second spectral radiance sensor 18.

The diffuser plate 17 diffuses and transmits the external light irradiating the diffuser plate 17 from the front side of the LCD module 11, thereby supplying to the second spectral radiance sensor 18. The second spectral radiance sensor 18 is a detection device which is disposed next to the back of the diffuser plate 17, and detects a spectral characteristic of external light supplied from the diffuser plate 17. Four each of the diffuser plate 17 and the second spectral radiance sensor 18 are arranged at a peripheral portion of a screen of the LCD module 11. The diffuser plates 14 and 17 are arranged for the purpose of prevention of damage due to direct light incidence and prevention of deterioration in measurement accuracy due to various image formations for the first spectral radiance sensor 16 and the second spectral radiance sensor 18, which therefore are not necessarily limited to the present configuration.

FIG. 14A is a front view schematically showing external appearance of the semi-transmissive liquid crystal display apparatuses 1A, and FIG. 14B is a front view schematically showing external appearance of the semi-transmissive liquid crystal display apparatuses 1B which is a modified example of the semi-transmissive liquid crystal display apparatuses 1A. FIGS. 14A and 14B show arrangement of four of the second spectral radiance sensors 18 and illustration of the diffuser plates, each of which is disposed next to each second spectral radiance sensor 18 is omitted. Second spectral radiance sensors 18*a* to 18*d* shown in FIG. 14A, or second spectral radiance sensors 18*e* to 18*h* shown in FIG. 14B are collectively referred to as the second spectral radiance sensor 18.

In the semi-transmissive liquid crystal display apparatuses 1A shown in FIG. 14A, each of the second spectral radiance sensors 18*a* to 18*d* is arranged for each of corners of the peripheral portion of the screen of the LCD module 11. The display screen of the LCD module 11 shown in FIG. 14A is divided into four areas R1*a* to R1*d* by a straight line which is perpendicular to centers of long sides in the lateral direction and a straight line which is perpendicular to centers of short sides in the vertical direction. A second spectral radiance sensor 18*a* is a spectral radiance sensor for performing color correction in the area R1*a*, a second spectral radiance sensor 18*b* is a spectral radiance sensor for performing color correction in the area R1*b*, a second spectral radiance sensor 18*c* is a spectral radiance sensor for performing color correction in the area R1*c*, and a second spectral radiance sensor 18*d* is a spectral radiance sensor for performing color correction in the area R1*d*.

In the semi-transmissive liquid crystal display apparatuses 1B shown in FIG. 14B, respective second spectral radiance sensors 18*e* to 18*h* are arranged one by one at center parts in the long side direction and at center parts in the short side direction of the peripheral portion of the screen of the LCD module 11. The display screen of the LCD module 11 shown in FIG. 14B is divided into four areas R1*e* to R1*h* by two diagonal lines. A second spectral radiance sensor 18*e* is a spectral radiance sensor for performing color correction in the area R1*e*, a second spectral radiance sensor 18*f* is a spectral radiance sensor for performing color correction in the area R1*f*, a second spectral radiance sensor 18*g* is a spectral radiance sensor for performing color correction in the area R1*g*, and a second spectral radiance sensor 18*h* is a spectral radiance sensor for performing color correction in the area R1*h*.

Hereinafter, although the semi-transmissive liquid crystal display apparatus 1A shown in FIG. 14A is taken as an example to be described, however, in the semi-transmissive liquid crystal display apparatus 1B shown in FIG. 14B, the operation is the same except that the arrangement of the areas and the second spectral radiance sensors 18 is different.

FIG. 13B is a view schematically showing examples of the optical fiber 15*a* and the spectral radiance sensor 16*a* each having a configuration different from that shown in FIG. 13A. In the configuration shown in FIG. 1B, the optical fiber 15*a*, the spectral radiance sensor 16*a* and the electronic shutters 19*a*, 19*b*1 to 19*b*4 are used in place of the optical fiber 15, the first spectral radiance sensor 16 and the second spectral radiance sensor 18 shown in FIG. 1A.

The optical fiber 15*a* guides and supplies irradiation light acquired through the diffuser plate 14 to the spectral radiance sensor 16*a* as well as guiding and supplying external light acquired through the four diffuser plates 17 to the spectral radiance sensor 16*a*. The optical fiber 15*a* is connected to the diffuser plate 14 through the electronic shutter 19*a* as well as connected to the four diffuser plates 17 respectively through the electronic shutters 19*b*1 to 19*b*4. The electronic shutters 19*a*, 19*b*1 to 19*b*4 will not be opened simultaneously, and all of them are closed, or only one of them is opened.

The spectral radiance sensor 16*a* is a detection device for detecting a spectral characteristic of incident light supplied from the optical fiber 15. When the electronic shutter 19*a* is opened, the spectral radiance sensor 16*a* detects a spectral characteristic of the irradiation light acquired through the diffuser plate 14, when the electronic shutter 19*b*1 is opened, detects a spectral characteristic of the external light acquired through the diffuser plate 17 to which the electronic shutter 19*b*1 is connected, when the electronic shutter 19*b*2 is opened, detects a spectral characteristic of the external light acquired through the diffuser plate 17 to which the electronic shutter 19*b*2 is connected, when the electronic shutter 19*b*3 is opened, detects a spectral characteristic of the external light acquired through the diffuser plate 17 to which the electronic shutter 19*b*3 is connected, and when the electronic shutter 19*b*4 is opened, detects a spectral characteristic of the external light acquired through the diffuser plate 17 to which the electronic shutter 19*b*4 is connected.

Each of the first spectral radiance sensor 16, the second spectral radiance sensor 18 and the spectral radiance sensor 16*a* is configured by, for example, a spectral radiance meter of a polychromator-type using a diffraction grating or a luminance colorimeter of a filter type. The polychromator-type spectral radiance meter focuses light to be measured with a lens, separates the focused light with a grating or a diffraction grating for each wavelength, and measures luminance for each wavelength with a plurality of photo sensors, for example, a photodiode array. The luminance colorimeter of the filter type is inferior in accuracy to the spectral radiance meter of the polychromator-type. The first spectral radiance sensor 16 is a first spectral characteristic detection section and the second spectral radiance sensor 18 is a second spectral characteristic detection section.

In the configuration shown in FIG. 13A, five spectral radiance sensors of the first spectral radiance sensor 16 and the four second spectral radiance sensors 18 are used, however, in the configuration shown in FIG. 13B, the one spectral radiance sensor 16*a* is only needed so that the number of the spectral radiance sensors is able to be reduced.

In the examples shown in FIGS. 14A and 14B, examples in which the four second spectral radiance sensors 18 are used are shown, however, the number of the second spectral radiance sensor 18 is not limited to four, and for example, it is also possible to provide two, three, or five or more of them according to the size of the display screen.

Figure 15:
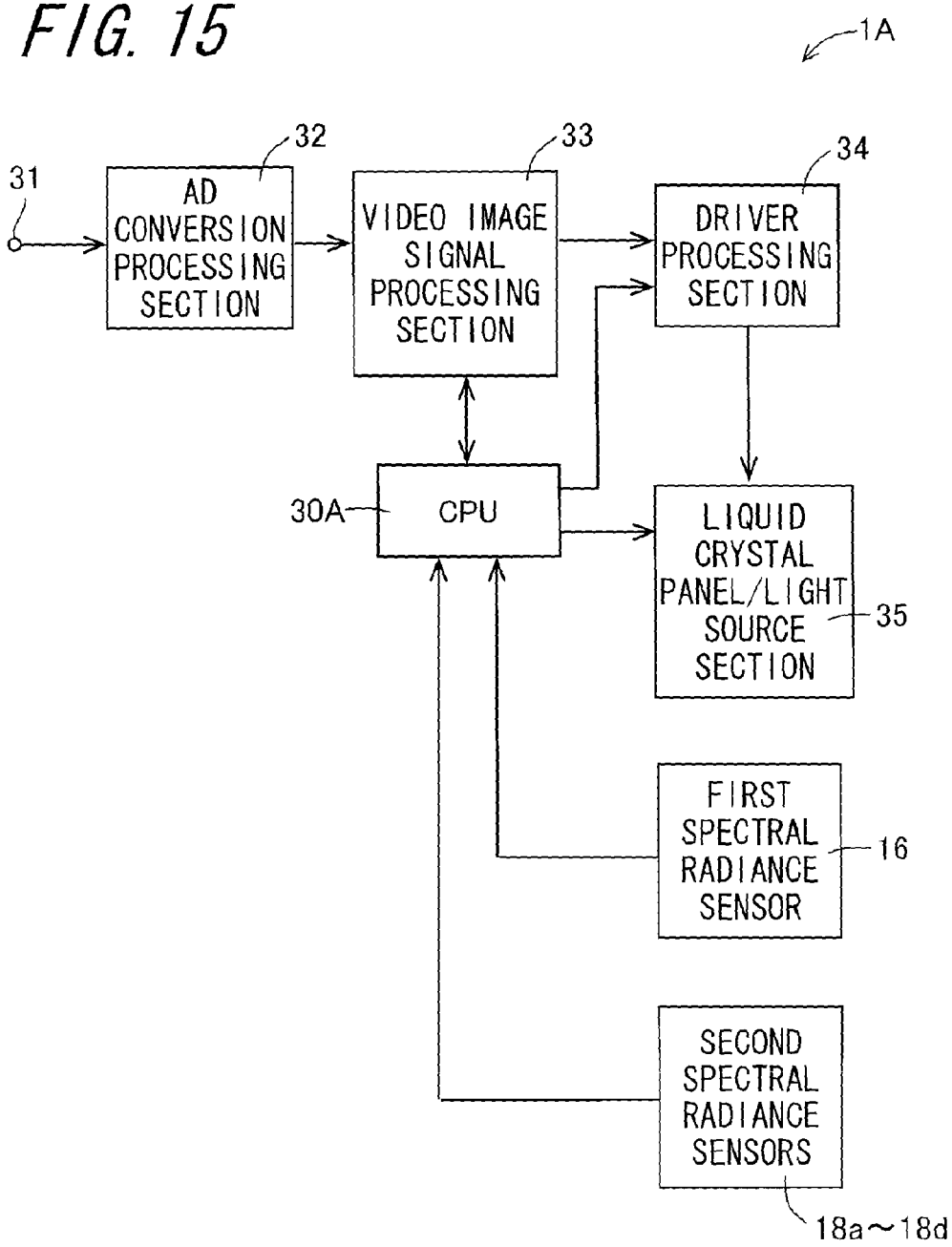
FIG. 15 is a block diagram showing a configuration of the semi-transmissive liquid crystal display apparatus.

FIG. 15 is a block diagram showing a configuration of the semi-transmissive liquid crystal display apparatus 1A. The semi-transmissive liquid crystal display apparatus 1A comprises a central processing unit (abbreviated as CPU) 30A, a storage device (not shown), an input terminal 31, an analog-digital (hereinafter, referred to as "AD") conversion processing section 32, a video image signal processing section 33, a driver processing section 34 and a liquid crystal panel/light source section 35, in addition to the first spectral radiance sensor 16 and the second spectral radiance sensor 18 shown in FIG. 13A.

The CPU 30A, which is a control section, executes a program stored in a storage device (not shown) so as to control the video image signal processing section 33, the driver processing section 34 and the liquid crystal panel/light source section 35. The storage device (not shown) is composed of a semiconductor memory, for example, and stores a program executed by the CPU 30A and information used by the CPU 30A in executing the program.

The video image signal processing section 33 performs color correction of image information received from the AD conversion processing section 32 by an instruction from the CPU 30A, and the image information subjected to the color correction is transmitted to the driver processing section 34.

The liquid crystal panel/light source section 35 comprises the LCD module 11, the half mirror 12 and the backlight 13 shown in FIG. 13A. The liquid crystal panel/light source section 35 allows only the reflection light from the half mirror 12, or the reflection light from the half mirror 12 and the irradiation light from the backlight 13 to pass through the color filter of the LCD module 11 so that color of the image information is produced. The first spectral radiance sensor 16 transmits the detected spectral characteristic to the CPU 30A, and the second spectral radiance sensors 18*a* to 18*d*, each of which transmits to the CPU 30A a spectral characteristic detected thereby. Hereinafter, the spectral characteristic is also referred to as spectral radiance.

The CPU 30A generates for each of the areas R1*a* to R1*d* parameter information which is color correction information required for color correction to be performed by the video image signal processing section 33 based on the spectral radiance received from the first spectral radiance sensor 16, the spectral radiance received from the second spectral radiance sensors 18*a* to 18*d*, as well as spectral transmittance of a color filter, a spectral reflectivity of the half mirror 12, which are described below, and a color-matching function, described below, of XYZ colorimetric system which are described below. The CPU 30A transmits to the video image signal processing section 33 four pieces of the parameter information generated for each of the areas R1*a* to R1*d*. Based on the received four pieces of parameter information, the video image signal processing section 33 performs color correction to the image information received from the AD conversion processing section 32 for each of the areas R1*a* to R1*d*. The spectral radiance received from the first spectral radiance sensor 16 is spectral radiance of irradiation light from the backlight 13, which hereinafter will simply be referred to as spectral radiance of a backlight or also as a spectral characteristic of a backlight.

In reference to FIG. 3, the CPU 30A generates a backlight spectral luminance matrix L1 and an external light spectral luminance matrix L2 for each of the areas R1*a* to R1*d*. The backlight spectral luminance matrix L1 is a matrix expressing luminance for each wavelength represented by the light source spectral luminance 511 of a backlight measured by the first spectral radiance sensor 16. The external light spectral luminance matrix L2 generated for each of the areas R1*a* to R1*d* is a matrix expressing luminance for each wavelength represented by the light source spectral luminance 512 of external light measured by each of the second spectral radiance sensors 18*a* to 18*d*. Specifically, each of the backlight spectral luminance matrix L1 and the external light spectral luminance matrix L2 is a matrix with 401 rows×1 column expressing luminance at a wavelength in increments of 1 nm wavelength within a wavelength range of 380 nm to 780 nm wavelength.

In reference to FIG. 4, immediately after the semi-transmissive liquid crystal display apparatus 1A is turned on, the CPU 30A reads the spectral transmittance of the color filter from the storage device (not shown) to generate a spectral transmittance matrix C. The spectral transmittance matrix C is a matrix expressing luminance for each wavelength represented by the spectral transmittance 521 of red light, the spectral transmittance 522 of green light, and the spectral transmittance 523 of blue light. Specifically, the spectral transmittance matrix C is a matrix with 401 rows and 3 columns expressing luminance at a wavelength in increments of 1 nm wavelength within the wavelength range of 380 nm to 780 nm wavelength in 3 columns in total which are 401 rows and 1 column for red light, 401 rows and 1 column for green light, and 401 rows and 1 column for blue light.

In reference to FIG. 5, the spectral characteristic 531 of red light, the spectral characteristic 532 of green light, and the spectral characteristic 533 of blue light in the graph 53 are able to be obtained from the light source spectral luminance 511 of the backlight shown in FIG. 3, the spectral transmittance 521 of red light, the spectral transmittance 522 of green light and the spectral transmittance 523 of blue light shown in FIG. 4. Specifically, the CPU 30A obtains a matrix in which respective matrix elements of the backlight spectral luminance matrix L1 and the spectral transmittance matrix C are multiplied by one another, that is a matrix of an operation result of L1×C. Values of the matrix as the operation result of L1×C are plotted as shown in the graph 53.

In reference to FIG. 6, the spectral characteristic 541 of red light, the spectral characteristic 542 of green light, and the spectral characteristic 543 of blue light in the graph 54 are able to be obtained from the light source spectral luminance 512 of external light shown in FIG. 3, the spectral transmittance 521 of red light, the spectral transmittance 522 of green light and the spectral transmittance 523 of blue light shown in FIG. 4. Specifically, the CPU 30A obtains a matrix in which respective matrix elements of the external light spectral luminance matrix L2 and the spectral transmittance matrix C are multiplied by one another, that is a matrix of an operation result of L2×C for each of the areas R1*a* to R1*d*. Values of the matrix as the operation result of L2×C are plotted as shown in the graph 54.

In reference to FIG. 7, the CPU 30A generates a color matching function matrix S expressing a color matching function. Specifically, immediately after the display apparatus is turned on, the CPU 30A reads a luminous sensitivity characteristic of a color-matching function from the storage device (not shown), and based on the read luminous sensitivity characteristic of a color matching function, generates a color matching function matrix S. The color-matching function matrix S is a matrix expressing a tristimulus value for each wavelength represented by the luminous sensitivity characteristic 551 of red light, the luminous sensitivity characteristic 552 of green light and the luminous sensitivity characteristic 553 of blue light. The color matching function matrix S is a matrix with 401 rows and 3 columns expressing luminance at a wavelength in increments of 1 nm wavelength within the wavelength range of 380 nm to 780 nm wavelength in 3 columns in total which are 401 rows and 1 column for red light, 401 rows and 1 column for green light, and 401 rows and 1 column for blue light.

In reference to FIGS. 8A and 8B, the CPU 30A detects spectral radiance of external light for each first time interval, for example, per hour, and determines that the external light has changed when the arithmetic average en is 10% or more of a first evaluation determination value which is a first threshold, for example, maximum luminance at the time point t1, and newly calculates parameter information for transmitting the calculated parameter information to the video image signal processing section 33 so as to cause color correction to be performed based on the parameter information.

Since the CPU 30A operates the correction matrix only when the arithmetic average en is greater than or equal to the first evaluation determination value, there is no need to generate parameter information every time, so that processing time is able to be shortened when there is no need to operate the correction matrix.

Further, the CPU 30A detects the spectral radiance of external light for each first time interval, and converts the detected spectral radiance of external light ($W/(sr \cdot m^2 \cdot nm)$) to a luminance value ($cd/m^2$). When the ratio of the value to a value of conversion from the spectral radiance to the luminance value of the backlight is greater than or equal to a second evaluation determination value, for example, a ratio in which luminance of external light is twice or more of the backlight luminance, the backlight 13 is turned off so that display is performed only with the external light. When a ratio of a luminance value of the external light to a luminance value of the backlight is less than the second evaluation determination value, the backlight 13 is turned on so that display is performed with the external light and the irradiation light of the backlight 13. The conversion from the spectral radiance to the luminance value is obtained from a value of integral of the spectral radiance in 380 nm to 780 nm.

The first color correction processing is processing in a case where whether or not display is performed only with external light is switched according to the luminance of the external light. In reference to FIG. 9, when the semi-transmissive liquid crystal display apparatus 1A is turned on to be in an operable state, the CPU 30A is operated so that the procedure goes to step A1. Further, also in the case where spectral radiance of the external light becomes less than the spectral radiance of a backlight at the time point of factory shipment, the procedure goes to step A1. The CPU 30A performs first color correction processing for each of the areas R1*a* to R1*d*.

At step A1, the CPU 30A instructs the liquid crystal panel/light source unit 35 to turn on the backlight 13 so that the backlight 13 is turned on. At step A2, the CPU 30A detects spectral radiance of external light with the second spectral radiance sensors 18*a* to 18*d* for each first time interval. At step A3, when all the spectral radiance of external light detected by the second spectral radiance sensors 18*a* to 18*d* is greater than the spectral radiance of backlight at the time point of factory shipment, the CPU 30A is operated so that the procedure proceeds to step A4. When the spectral radiance of external light detected by at least any one of the second spectral radiance sensors 18*a* to 18*d* is less than or equal to the spectral radiance of the backlight at the time point of factory shipment, the procedure returns to step A1.

At step A4, the CPU 30A instructs the liquid crystal panel/light source section 35 to turn off the backlight 13 so that the backlight 13 is turned off. At step A5, the CPU 30A performs correction operation processing of XYZ colorimetric system, that is, generation of parameter information for each of the areas R1*a* to R1*d* so that color produced with external light, namely, color produced with reflection light of external light with the half mirror 12 conforms to color produced only with irradiation light of the backlight 13. The generated parameter information is then transmitted to the video image signal processing section 33 so as to cause color correction to be performed based on the parameter information to finish the first color correction processing.

The second color correction processing is processing in the case where without depending on luminance of external light, the backlight 13 is used in combination therewith all the time. In reference to FIG. 10, when the semi-transmissive liquid crystal display apparatus 1A is turned on to be in an operable state, the CPU 30A is operated so that the procedure goes to step B1. Further, every time after the first time, the procedure goes to step B1. The CPU 30A performs second color correction processing for each of the areas R1*a* to R1*d*.

At step B1, the CPU 30A detects the spectral radiance of external light with the second spectral radiance sensor 18. At step B2, the CPU 30A detects the spectral radiance of the backlight with the first spectral radiance sensor 16. At step B3, the CPU 30A performs correction operation processing of XYZ colorimetric system, that is, generation of parameter information so that color produced when external light is used in combination with the backlight 13 conforms to color produced only with irradiation light of the backlight 13 at the time point of factory shipment. The generated parameter information is then transmitted to the video image signal processing section 33 so as to cause color correction to be performed based on the parameter information to finish the second color correction processing.

In considering temporal change of the backlight 13, for the backlight 13, the CPU 30A detects spectral radiance with the first spectral radiance sensor 16 at a predetermined time point, for example, at a time point of factory shipment, as well as for each second time interval after the predetermined time point, for example, for each month. Then it is determined that there has been temporal change in the backlight 13 when the arithmetic average en of a difference between the detected spectral radiance and the spectral radiance at the time point of factory shipment (absolute value) is 10% or more of a third evaluation determination value which is a second threshold, for example, maximum luminance at the time point of factory shipment. In the case of determination that there has been temporal change in the backlight 13, the CPU 30A generates a correction matrix B for correcting color shift along with the temporal change in the backlight 13 based on the detected spectral radiance of the backlight and the spectral radiance of the backlight at the time point of factory shipment. With the temporal change of the backlight, when change from L1 to L1' is assumed to occur, a correction matrix M' in the above-described formula (10) is also considered.

As the result, the correction matrix B considering the temporal change becomes $B=N^{-1} \cdot M'^{-1} \cdot M$. At step B3, the CPU 30A transmits the temporal change correction matrix B to the video image signal processing section 33 as parameter information so that color correction is caused to be performed based on the parameter information, thereby finishing the second color correction processing.

In reference to FIG. 11, the color gamut 601 is color gamut at the time of performing color correction to color produced with external light in the semi-transmissive liquid crystal display apparatus 1A, and the color gamut 602 is color gamut in producing color only with a backlight 13. Also in the embodiment, similarly to the above-described embodiment, the border line of the color gamut 601 coincides with the border line of the color gamut 602. Further, the white point 603 when color correction is performed for producing color with external light in the semi-transmissive liquid crystal display apparatus 1A coincides with the white point 604 with only the backlight 13.

Figure 16:
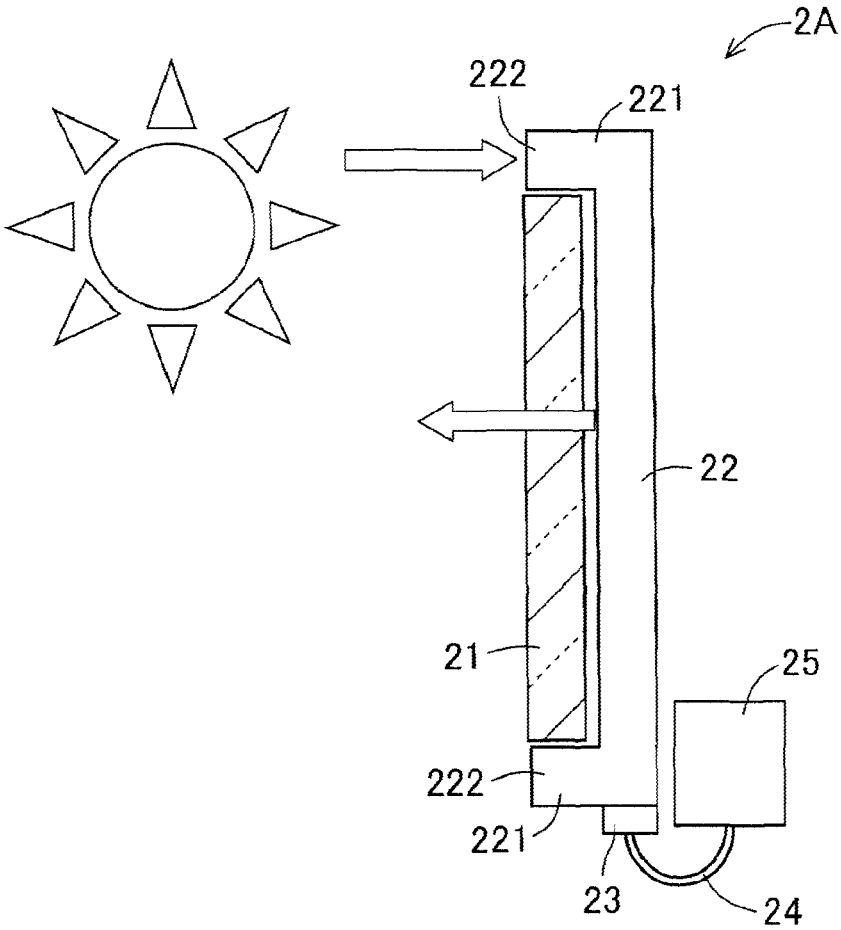
FIG. 16 is a side view schematically showing external appearance of a transmissive liquid crystal display apparatus according to a fourth embodiment of the invention.
Figure 17A:
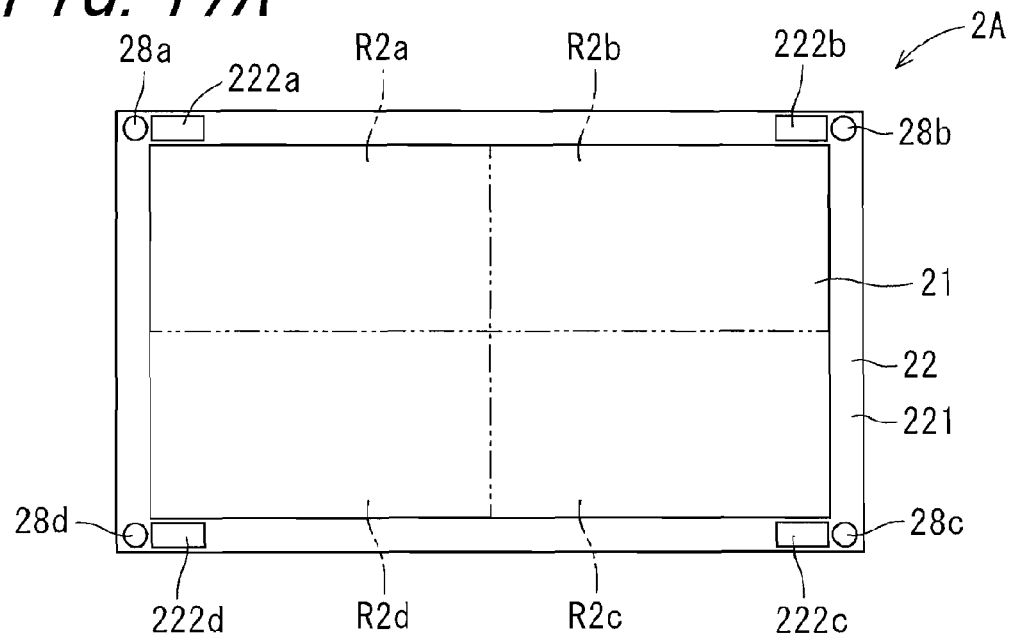
FIG. 17A is a front view schematically showing external appearance of the transmissive liquid crystal display apparatus.
Figure 17B:
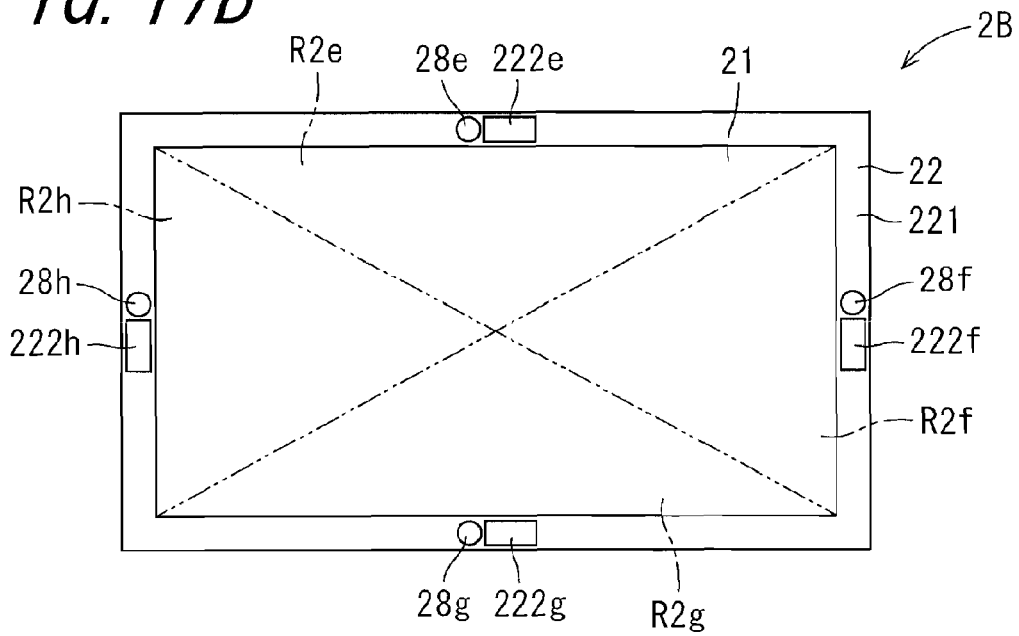
FIG. 17B is a front view schematically showing external appearance of a transmissive liquid crystal display apparatus.
Figure 18:
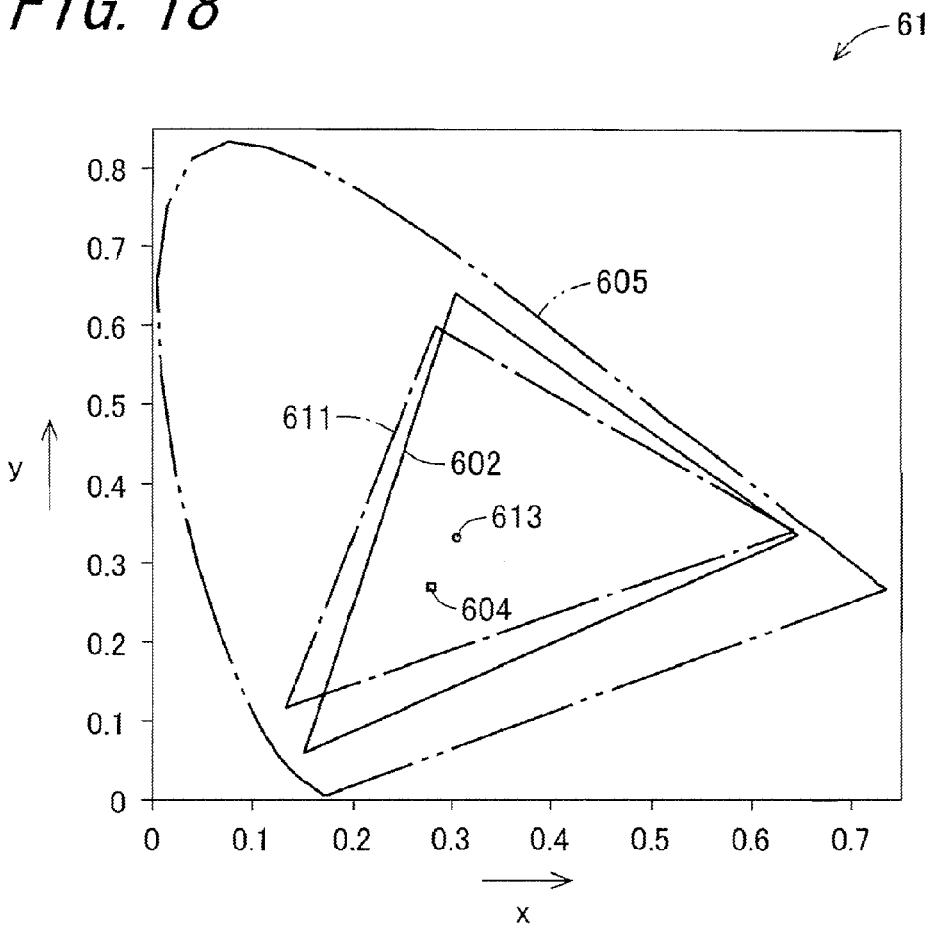
FIG. 18 is a view showing xy chromaticity at the time of occurrence of color shift due to an effect of external light.

FIG. 16 is a side view schematically showing external appearance of a transmissive liquid crystal display apparatus 2A according to a fourth embodiment of the invention. FIGS. 17A and 17B are front views schematically showing external appearances of transmissive liquid crystal display apparatuses 2A and 2B. The transmissive liquid crystal display apparatus 2A, which is a display apparatus, comprises the LCD module 21, the backlight 22, the diffuser plate 23, the optical fiber 24 and the spectral radiance sensors 25 and 28*a* to 28*d*. The LCD module 21, the diffuser plate 23, the optical fiber 24, and the spectral radiance sensor 25 have the same configuration respectively as the LCD module 11, the diffuser plate 14, the optical fiber 15 and the first spectral radiance sensor 16 as shown in FIG. 13A, and description thereof is omitted for avoiding redundancy. Further, each of the second spectral radiance sensors 28*a* to 28*d* shown in FIGS. 17A and 17B have the same configuration as the second spectral radiance sensor 18 and the diffuser plate 17 is provided for each thereof, however, the diffuser plate 17 is not shown in FIG. 16, FIG. 17A, and FIG. 17B.

The backlight 22 is composed of, for example, an edge light-type backlight, and comprises a light source (not shown) and a light guide plate (not shown). The backlight 22 has at the peripheral section 221 of the backlight 22 four external light intakes 222 and four second spectral radiance sensors 28 provided. Each of the second spectral radiance sensors 28 is disposed next to each of the external light intakes 222 one by one. Each of the second spectral radiance sensors 28 detects spectral radiance of external light which is irradiated in the vicinity of the external light intake 222 which is next thereto and each of the detected spectral radiance of external light is transmitted to the CPU 30A.

FIG. 17A is a front view schematically showing external appearance of the transmissive liquid crystal display apparatus 2A, and FIG. 17B is a front view schematically showing external appearances of the transmissive liquid crystal display apparatuses 2B which is a modified example of the transmissive liquid crystal display apparatus 2A. FIGS. 17A and 17B show arrangements of the four external light intakes 222 and the four second spectral radiance sensors 28. The external light intakes 222*a* to 222*d* shown in FIG. 17A or external light intakes 222*e* to 222*h* shown in FIG. 17B are collectively referred to as the external light intake 222 which is the external light intake section. The second spectral radiance sensors 28*a* to 28*d* shown in FIG. 17A, or the second spectral radiance sensors 28*e* to 28*h* shown in FIG. 17B are collectively referred to as the second spectral radiance sensor 28.

In the transmissive liquid crystal display apparatus 2A shown in FIG. 17A, a set of each of the four external light intakes 222 and each of the four second spectral radiance sensors 28 is arranged for each of corners of the peripheral section 221 of the backlight 22. The display screen of the LCD module 21 shown in FIG. 17A is divided into four areas R2*a* to R2*d* by a straight line which is perpendicular to the centers of long sides in the lateral direction and a straight line which is perpendicular to the centers of short sides in the vertical direction. A second spectral radiance sensor 28*a* is a spectral radiance sensor for performing color correction in the area R2*a*, second spectral radiance sensor 28*b* is a spectral radiance sensor for performing color correction in the area R2*b*, a second spectral radiance sensor 28*c* is a spectral radiance sensor for performing color correction in the area R2*c*, and a second spectral radiance sensor 28*d* is a spectral radiance sensor for performing color correction of the area R2*d*.

In the transmissive liquid crystal display apparatus 2B shown in FIG. 17B, a set of each of the four external light intakes 222 and each of the four second spectral radiance sensors 28 is arranged for each of center parts in a long side direction and a short side direction of the peripheral section 221 of the backlight 22. A display screen of the LCD module 21 shown in FIG. 17B is divided into four areas R2*e* to R2*h* by two diagonal lines. A second spectral radiance sensor 28*e* is a spectral radiance sensor for performing color correction in the area R2*e*, a second spectral radiance sensor 28*f* is a spectral radiance sensor for performing color correction in the area R2*f*, a second spectral radiance sensor 28*g* is a spectral radiance sensor for performing color correction in the area R2*g*, and a second spectral radiance sensor 28*h* is a spectral radiance sensor for performing color correction in the area R2*h*.

Hereinafter, the transmissive liquid crystal display apparatus 2A shown in FIG. 17A is taken as an example for description, however, in the transmissive liquid crystal display apparatus 2B shown in FIG. 17B, the operation is the same except that arrangement of the areas, the external light intakes 222, and the second spectral radiance sensors 28 is different.

Each of the external light intakes 222 takes in external light coming from the front side of the LCD module 21. External light taken in from each of the external light intakes 222 is supplied to a light guide plate. Further, irradiation light emitted from a light source of the backlight 22 is also supplied to the light guide plate. The backlight 22 emits the external light taken in from each of the external light intakes 222 and the irradiation light emitted from the light source from the light guide plate so as to be passed through from the back of the LCD module 21 to the front side of the LCD module 21. The external light taken in from the external light intake 22 is acquired external light.

The diffuser plate 23 is disposed below the backlight 22 in a surface direction of the screen of the LCD module 21, and connected to the light guide plate. The diffuser plate 23 diffuses and transmits the external light emitted from the light guide plate and taken in from the external light intake 222 and the irradiation light emitted from the light source so that the external light and the irradiation light are supplied to the optical fiber 24. The spectral radiance sensor 25 detects spectral characteristics of the external light and the irradiation light supplied from the optical fiber 24.

The CPU 30A performs the same processing as the second color correction processing as shown in FIG. 10, therefore description thereof is omitted for avoiding redundancy. Further, in measuring spectral radiance of external light, it is also possible to turn off the backlight 22 and detect spectral radiance of only external light so that the same processing as the first color correction processing is performed.

In the transmissive liquid crystal display apparatuses 2A and 2B, since there is a possibility that color shift occurs in color being produced on both sides of a border line of each of the areas by color correction with a correction matrix which is different for each of the areas, correction may be further added on pixels on both sides near the border line by weighted average.

The transmissive liquid crystal display apparatus 2A uses the spectral radiance sensor 25 in place of the first spectral radiance sensor 16 shown in FIG. 13A and uses the second spectral radiance sensor 28 in place of the second spectral radiance sensor 18. Further, in the transmissive liquid crystal display apparatus 2, the liquid crystal panel/light source section 35 comprises the LCD module 21 and the backlight 22 shown in FIG. 16 without including the half mirror 12.

According to the half mirror 12 shown in FIG. 13A, external light attenuates due to the LCD module 11 so that reflection light of external light by the half mirror 12 is weak, however, in the transmissive liquid crystal display apparatus 2A shown in FIG. 16, the external light intake 222 is disposed so that the external light itself is able to be used as a backlight, it is thereby possible to supply the stronger light than the reflection light of the external light by the half mirror 12 to the LCD module 21.

In the examples shown in FIGS. 17A and 17B, examples in which the four external light intakes 222 and the four second spectral radiance sensors 28 are used are shown, however, both the number of the external light intakes 222 and the number of the second spectral radiance sensors 18 are not limited to four, and for example, it is also possible to provide two, three, or five or more of them, respectively, according to the size of the display screen.

In the above-described embodiment, the arithmetic average is used to detect change of external light and temporal change of the backlight 13, however, it is also possible to make determination based on luminance at a representative wavelength such as the wavelength of 550 nm.

In this manner, when irradiation light caused by irradiation of the backlight 13 disposed at the back side of the LCD module 11, which is the opposite side of the display screen displaying image information on the display screen divided into a plurality of areas; and reflection light of external light by the half mirror 12 disposed between the LCD module 11 and the backlight 13 or acquired external light acquired by the external light intake 222 disposed at the peripheral section of the LCD module 11; or the reflection light or the acquired external light is caused to pass through the color filter disposed at the LCD module 11 to produce color of image information, the first spectral radiance sensor 16 detects a spectral characteristic which is represented as luminous energy of the irradiation light at a predetermined wavelength interval within a predetermined wavelength range. A plurality of the second spectral radiance sensors 18 are disposed on the peripheral section of the display screen of the LCD module 11 corresponding to each of the plurality of areas, and detects a spectral characteristic which is represented as luminous energy of external light irradiating the LCD module 11 from outside at a predetermined wavelength interval within a predetermined wavelength range. The video image signal processing section 33 performs color correction of the image information to be displayed on the LCD module 11, and supplies the image information to which color correction is performed to the LCD module 11 for display. Then the CPU 30A causes the first spectral radiance sensor 16 to detect the spectral characteristics of the luminous energy of the irradiation light, and causes the second spectral radiance sensor 18 to detect the spectral characteristics of the luminous energy of the external light, generates parameter information for each of the areas based on the spectral characteristic of the irradiation light which is detected by the first spectral radiance sensor 16 and the spectral characteristic of the external light which is detected by the plurality of second spectral radiance sensors 18, and supplies the generated parameter information to the video image signal processing section 33 so as to cause the video image signal processing section 33 to perform color correction of image information to be displayed for each of the areas based on the supplied parameter information. In the case of the transmissive liquid crystal display apparatus 2, the LCD module 11 is the LCD module 21, the backlight 13 is the backlight 22, the first spectral radiance sensor 16 and the second spectral radiance sensor 18 are the spectral radiance sensor 25, which are the same in the following description.

Therefore, it is possible to correct color shift for each of the areas of the screen due to an effect of external light and the like. Especially, in digital signage using the display apparatus, for example, the semi-transmissive liquid crystal display apparatus 1, or the transmissive liquid crystal display apparatus 2 capable of achieving high luminance with acquired external light, the spectral characteristic of irradiation light from the backlight 13 is detected by the first spectral characteristic detection section such as the first spectral radiance sensor 16, the spectral characteristic of external light is detected by the plurality of second spectral characteristic detection sections such as the second spectral radiance sensors 18, and color correction is performed for each of the areas based on the detected spectral characteristics so that deterioration in visibility due to an effect of external light or temporal change of the backlight 13 is prevented, and allowing to mend the problem of color shift and shortage of luminance in the backlight irradiation mode, the external light mode, and backlight irradiation and the external light mode in the semi-transmissive liquid crystal display apparatus 1 or the transmissive liquid crystal display apparatus 2.

Moreover, in both cases of placing in outdoors subjected to an effect of external light and placing indoors depending on backlight irradiation, color shift does not occur even when the same image is displayed, so that an observer is not given a sense of discomfort in color reproducibility, and it is possible to achieve the display apparatus capable of being used both for placing outdoors and for placing indoors.

Further, the CPU 30A calculates, for each of the areas, a correction matrix for color correction based on the spectral characteristics of irradiation light detected by the first spectral radiance sensor 16 and the spectral characteristics of external light detected by the second spectral radiance sensor 18, the spectral transmittance of the color filter disposed at the LCD module 11 as well as the color matching function to define the calculated correction matrix as parameter information. Accordingly, the correction matrix which is the parameter information capable of performing correction of color shift more accurately is able to be calculated for each of the areas.

Further, the CPU 30A, for each of the areas, causes the second spectral radiance sensor 18 to detect spectral characteristics of external light irradiating the LCD module 11 from outside for each first time interval. Then, when a difference of the spectral characteristic of the external light between a start time point of the first time and a time point after the first time is greater than or equal to a first threshold, the CPU 30A generates parameter information. Therefore, when the degree of color shift is small which is caused by deterioration in performance along with temporal change of the external light, it is possible to omit operation processing for performing the color correction, thereby not causing delay in screen display.

Further, the CPU 30A causes the first spectral radiance sensor 16 to detect the spectral characteristic of the irradiation light from the backlight 13 at each predetermined time point and for each second time interval after the predetermined time point. Then, when the difference between the spectral characteristic at the predetermined time point and the spectral characteristic at the second time interval is greater than or equal to a second threshold, based on the spectral characteristic at the predetermined time point and the spectral characteristics at the second time interval, the CPU 30A generates color correction information for bringing color of image information produced by irradiation light of the spectral characteristic which is the second threshold to conform to color of image information produced with irradiation light at the predetermined time point, and supplies the generated color correction information to the video image signal processing section 33.

Therefore, even when there occurs change due to temporal change in irradiation light by the backlight 13 used in a display apparatus, color correction for temporal change is performed so that color shift due to deterioration in performance of the backlight 13 is suppressed, thereby making it possible to maintain display of color produced in a condition which is equivalent to that at the time of factory shipment of the display apparatus.

Moreover, when luminous energy shown by the spectral characteristic of external light detected by at least any one second spectral radiance sensor 18 among the plurality of second spectral radiance sensors 18 is less than the luminous energy shown by spectral characteristics of irradiation light detected by the first spectral radiance sensor 16, the 30A causes the backlight 13 to perform irradiation with irradiation light. Then, based on the spectral characteristic of the irradiation light detected by the first spectral radiance sensor 16 and the spectral characteristic of the external light detected by the plurality of second spectral radiance sensors 18, the CPU 30A generates, for each of the areas, parameter information for bringing color of image information produced when the irradiation light and the reflection light or the acquired external light are caused to pass through the color filter to conform to color of image information produced when only the irradiation light from the backlight 13 is caused to pass through the color filter.

Therefore, when there is a shortage of luminance in external light, the luminance is supplemented with luminance of the irradiation light by the backlight 13, so that it is possible to produce color of image information with light combining the irradiation light by the backlight 13 and the external light. Color correction is performed by obtaining, for each of the areas, parameter information for performing color correction, for example, a correction matrix based on the spectral characteristic of the irradiation light by the backlight 13 and the spectral characteristic of the external light, so that it is possible to obtain display of color produced which is equivalent to that in the case with only the irradiation light by the backlight 13.

Further, the CPUs 30 and 30A calculate a difference between respective luminous energy shown by two spectral characteristics at the predetermined wavelength interval on the predetermined wavelength range to define an average of a total of the calculated difference as the difference of the two spectral characteristics. Therefore, even when the luminance changes depending on the wavelength, it is possible to obtain the difference between the two spectral characteristics.

Further, the spectral characteristic is a luminance characteristic represented for each wavelength in a visible light area (380 to 780 (nm)), so that it is possible to perform correction for each wavelength, and to perform more accurate correction of color shift.

Further, the display apparatus further includes diffuser plates 14 and 17 for diffusing the irradiation light and the external light, and the first spectral radiance sensor 16 and the second spectral radiance sensor 18 detect a spectral characteristic of light diffused by the diffuser plates 14 and 17, so that even when there is unevenness in luminance regionally, it is possible to detect luminance appropriately.

Further, since optical fiber 15 for guiding a part of irradiation light caused by irradiation of the backlight 13 to the first spectral radiance sensor 16 is further included, even when the first spectral radiance sensor 16 is provided by being separated from the backlight 13, it is possible to suppress attenuation of light.

Further, in the second embodiment, the optical fiber 24 guides acquired external light acquired by the opening for acquiring external light to the spectral radiance sensor 25, so that it is possible to suppress attenuation of light also for acquired external light.

Further, in the fourth embodiment, the optical fiber 24 guides external light acquired by the plurality of external light intakes 222 to the spectral radiance sensor 25, so that it is possible to suppress attenuation of light also for external light.

Further, the display apparatus is a semi-transmissive liquid crystal display apparatus 1, 1A, 1B including the LCD module 11, the backlight 13, and the half mirror 12. Accordingly, it is possible to realize the apparatus as the semi-transmissive liquid crystal display apparatus 1, 1A, 1B with irradiation light by the backlight 13 and reflection external light as well as preventing deterioration in visibility due to external light, and allowing to suppress color shift and luminance change due to external light.

Further, the display apparatus is a transmissive liquid crystal display apparatus 2 including the LCD module 21, the backlight 22, and the external light intake 222, and the external light intake 222 is an opening for acquiring external light, and the backlight 22 includes the light guide plate guiding external light. Accordingly, it is possible to realize the apparatus as the transmissive liquid crystal display apparatus with irradiation light by the backlight 22 and the acquired external light by the opening and the light guide plate as well as preventing deterioration in visibility due to external light, and allowing to suppress color shift and luminance change due to external light.

Further, the display apparatus is a transmissive liquid crystal display apparatus 2A, 2B including the LCD module 21, the backlight 22, and the external light intakes 222. The external light intakes 222 are openings for acquiring external light disposed at the peripheral section of the backlight 22, and the backlight 22 includes the light guide plate guiding external light. Then, the plurality of second spectral radiance sensors 18, each of which, is arranged in the vicinity of each of the external light intakes 222. Accordingly, it is possible to realize the apparatus as the transmissive liquid crystal display apparatus 2A, 2B with irradiation light by the backlight 22 and the acquired external light by the plurality of openings and the light guide plate as well as preventing deterioration in visibility due to external light, and allowing to suppress color shift and luminance change due to external light.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

1, 1A, 1B: Semi-transmissive liquid crystal display apparatus
2, 2A, 2B: Transmissive liquid crystal display apparatus
11, 21: LCD module
12: Half mirror
13, 22: Backlight
14, 17, 23: Diffuser plate
15, 15*a*, 24: Optical fiber
16: First spectral radiance sensor
16*a*, 25: Spectral radiance sensor
18, 18*a* to 18*d*, 18*e* to 18*h*: Second spectral radiance sensor
30, 30A: CPU
31: Input terminal
32: AD conversion processing section
33: Video image signal processing section
34: Driver processing section
35: Liquid crystal panel/light source section

The invention claimed is:

1. A display apparatus, comprising:

a display section having a color filter and a display screen for displaying image information;

a backlight section disposed on a back side of the display section that is an opposite side of the display screen;

a half mirror disposed between the display section and the backlight section or an external light acquisition section disposed at a peripheral section of the display section, irradiation light caused by irradiation of the backlight section, and reflection light of external light by the half mirror or external light acquired by the external light acquisition section; or the reflection light or the acquired external light being allowed to pass through the color filter to produce color of image information, the display apparatus further comprising:

a spectral characteristic detection section that detects a spectral characteristic which is represented as luminous energy of the irradiation light and luminous energy of the external light irradiating the display section from outside at a predetermined wavelength interval within a predetermined wavelength range;

a color correction section that performs color correction of image information to be displayed on the display section, and supplies the image information subjected to the color correction to the display section for display; and a control section that causes the spectral characteristic detection section to detect the spectral characteristic of the luminous energy of the irradiation light and the spectral characteristic of the luminous energy of the external light, generates color correction information based on the spectral characteristic of the irradiation light and the spectral characteristic of the external light detected by the spectral characteristic detection section, and supplies the generated color correction information to the color correction section to cause the color correction section to perform color correction of image information to be displayed based on the supplied color correction information.

2. The display apparatus according to claim 1, wherein the control section calculates a correction matrix for color correction based on the spectral characteristic of the irradiation light and the spectral characteristic of the external light detected by the spectral characteristic detection section, spectral transmittance of the color filter disposed at the display section as well as a color matching function, to define the calculated correction matrix as color correction information.

3. The display apparatus according to claim 1, wherein the control section causes the spectral characteristic detection section to detect a spectral characteristic of external light irradiating the display section from outside for each first time interval, and generates the color correction information when a difference of the spectral characteristic of the external light between a start time point of the first time and a time point after the first time is greater than or equal to a first threshold.

4. The display apparatus according to claim 3, wherein the control section calculates a difference between respective luminous energy shown by two spectral characteristics at the predetermined wavelength interval on the predetermined wavelength range to define an average of a total of the calculated difference as a difference of the two spectral characteristics.

5. The display apparatus according to claim 1, wherein the control section causes the spectral characteristic detection section to detect a spectral characteristic of irradiation light from the backlight section at a predetermined time point and for each second time interval after the predetermined time point, and generates, when a difference between the spectral characteristic at the predetermined time point and the spectral characteristic at the second time interval is greater than or equal to a second threshold, based on the spectral characteristic at the predetermined time point and the spectral characteristic at the second time interval, color correction information for bringing color of image information produced with the irradiation light of the spectral characteristic which is the second threshold to conform to color of image information produced with the irradiation light at the predetermined time point, and supplies the generated color correction information to the color correction section.

6. The display apparatus according to claim 1, wherein the control section causes the backlight section to perform irradiation with irradiation light, when luminous energy shown by the spectral characteristic of the external light detected by the spectral characteristic detection section is less than luminous energy shown by the spectral characteristic of the irradiation light detected by the spectral characteristic detection section, and generates, based on the spectral characteristic of the irradiation light and the spectral characteristic of the external light detected by the spectral characteristic detection section, color correction information for bringing color of image information produced when the irradiation light and the reflection light or the acquired external light are allowed to pass through the color filter to conform to color of image information produced by allowing only the irradiation light from the backlight section to pass through the color filter.

7. The display apparatus according to claim 1, wherein the spectral characteristic is a luminance characteristic represented for each wavelength in a visible light area.

8. The display apparatus according to claim 1, further comprising a diffuser plate for diffusing the irradiation light and the acquired external light, wherein the spectral characteristic detection section detects a spectral characteristic of light diffused by the diffuser plate.

9. The display apparatus according to claim 1, further comprising an optical fiber for guiding a part of irradiation light caused by irradiation of the backlight section to the spectral characteristic detection section.

10. The display apparatus according to claim 9, wherein the optical fiber guides acquired external light acquired by the external light acquisition section or the plurality of external light acquisition sections to the spectral characteristic detection section.

11. The display apparatus according to claim 1, wherein the display apparatus is a semi-transmissive liquid crystal display apparatus including the display section, the backlight section and the half mirror.

12. The display apparatus according to claim 1, wherein the display apparatus is a transmissive liquid crystal display apparatus including the display section, the backlight section including a light guide plate that guides external light, and the external light acquisition section which is an opening for acquiring external light.

13. A display apparatus, comprising:

a display section having a color filter and a display screen divided into a plurality of areas for displaying image information;

a backlight section disposed on a back side of the display section that is an opposite side of the display screen; and a half mirror disposed between the display section and the backlight section or a plurality of external light acquisition sections disposed at a peripheral section of the display section, irradiation light caused by irradiation of the backlight section, and reflection light of external light by the half mirror or acquired external light acquired by the plurality of external light acquisition sections; or the reflection light or the acquired external light being allowed to pass through the color filter disposed at the display section to produce color of image information, the display apparatus further comprising:

a first spectral characteristic detection section that detects a spectral characteristic which is represented as luminous energy of the irradiation light at a predetermined wavelength interval within a predetermined wavelength range;

a plurality of second spectral characteristic detection sections that are disposed at the peripheral section of the display screen of the display section by being associated with each of the plurality of areas, and detect a spectral characteristic which is represented as luminous energy of external light irradiating the display section from outside at a predetermined wavelength interval within a predetermined wavelength range;

a color correction section that performs color correction of image information to be displayed on the display section, and supplies the image information subjected to the color correction to the display section for display; and a control section that causes the first spectral characteristic detection section to detect the spectral characteristic of the luminous energy of the irradiation light, causes the second spectral characteristic detection section to detect the spectral characteristic of the luminous energy of the external light, generates color correction information for each of the areas based on the spectral characteristic of the irradiation light detected by the first spectral characteristic detection section and the spectral characteristic of the external light detected by the plurality of second spectral characteristic detection sections, and supplies the generated color correction information to the color correction section for causing the color correction section to perform color correction of image information to be displayed for each of the areas based on the supplied color correction information.

14. The display apparatus according to claim 13, wherein the control section calculates, for each of the areas, a correction matrix for color correction based on the spectral characteristic of the irradiation light detected by the first spectral characteristic detection section and the spectral characteristic of the external light detected by the second spectral characteristic detection section, spectral transmittance of the color filter disposed at the display section as well as a color matching function, to define the calculated correction matrix as color correction information.

15. The display apparatus according to claim 13, wherein the control section, for each of the areas, causes the second spectral characteristic detection section to detect a spectral characteristic of external light irradiating the display section from outside for each first time interval, and generates the color correction information when a difference of the spectral characteristic of the external light between a start time point of the first time and a time point after the first time is greater than or equal to a first threshold.

16. The display apparatus according to claim 15, wherein the control section calculates a difference between respective luminous energy shown by two spectral characteristics at the predetermined wavelength interval on the predetermined wavelength range to define an average of a total of the calculated difference as a difference of the two spectral characteristics.

17. The display apparatus according to claim 13, wherein the control section causes the backlight section to perform irradiation with irradiation light, when luminous energy shown by the spectral characteristic of the external light detected by at least any one second spectral characteristic detection section among the plurality of second spectral characteristic detection sections is less than luminous energy shown by the spectral characteristic of the irradiation light detected by the first spectral characteristic detection section, and generates, for each of the areas, based on the spectral characteristic of the irradiation light detected by the first spectral characteristic detection section and the spectral characteristic of the external light detected by the plurality of second spectral characteristic detection sections, color correction information for bringing color of image information produced when the irradiation light and the reflection light or the acquired external light are allowed to pass through the color filter to conform to color of image information produced by allowing only the irradiation light from the backlight section to pass through the color filter.

18. The display apparatus according to claim 13, wherein the display apparatus is a transmissive liquid crystal display apparatus including the display section, the backlight section including a light guide plate that guides external light, and the external light acquisition section which is an opening disposed at a peripheral section of the backlight section for acquiring external light, and the plurality of second spectral characteristic detection sections, each of which is arranged in a vicinity of each of the external light acquisition sections.

19. The display apparatus according to claim 13, wherein the control section causes the first spectral characteristic detection section to detect a spectral characteristic of irradiation light from the backlight section at a predetermined time point and for each second time interval after the predetermined time point, and generates, when a difference between the spectral characteristic at the predetermined time point and the spectral characteristic at the second time interval is greater than or equal to a second threshold, based on the spectral characteristic at the predetermined time point and the spectral characteristic at the second time interval, color correction information for bringing color of image information produced with the irradiation light of the spectral characteristic which is the second threshold to conform to color of image information produced with the irradiation light at the predetermined time point, and supplies the generated color correction information to the color correction section.

20. The display apparatus according to claim 13, wherein the spectral characteristic is a luminance characteristic represented for each wavelength in a visible light area.

21. The display apparatus according to claim 13, further comprising a diffuser plate for diffusing the irradiation light and the acquired external light, wherein the first spectral characteristic detection section and the plurality of second spectral characteristic detection sections detect a spectral characteristic of light diffused by the diffuser plate.

22. The display apparatus according to claim 13, further comprising an optical fiber for guiding a part of irradiation light caused by irradiation of the backlight section to the first spectral characteristic detection section.

23. The display apparatus according to claim 22, wherein the optical fiber guides acquired external light acquired by the external light acquisition section or the plurality of external light acquisition sections to the second spectral characteristic detection section.

24. The display apparatus according to claim 13, wherein the display apparatus is a semi-transmissive liquid crystal display apparatus including the display section, the backlight section and the half mirror.

* * * * *